US012767188B2

(12) United States Patent
Farias Serra et al.

(10) Patent No.: US 12,767,188 B2
(45) Date of Patent: Oct. 20, 2026

(54) PROPULSION SYSTEM INCLUDING PROPELLERS

(71) Applicant: KEYSTONE HUMANS INC., San Diego, CA (US)

(72) Inventors: Arturo Jesus Farias Serra, Gibsons (CA); Juan Pablo Rico Garcia, San Diego, CA (US)

(73) Assignee: KEYSTONE HUMANS INC., San Diego, CA (US)

( * ) Notice: Subject to any disclaimer, the term of this patent is extended or adjusted under 35 U.S.C. 154(b) by 373 days.

(21) Appl. No.: 18/711,406

(22) PCT Filed: Nov. 21, 2022

(86) PCT No.: PCT/US2022/050565
§ 371 (c)(1),
(2) Date: May 17, 2024

(87) PCT Pub. No.: WO2023/091748
PCT Pub. Date: May 25, 2023

(65) Prior Publication Data

US 2025/0033676 A1 Jan. 30, 2025

Related U.S. Application Data

(60) Provisional application No. 63/281,232, filed on Nov. 19, 2021.

(51) Int. Cl.
*B61B 13/12* (2006.01)

(52) U.S. Cl.
CPC ..... *B61B 13/12* (2013.01)

(58) Field of Classification Search
CPC ..... B61B 13/125; B61B 13/00; B61B 13/12; B60L 13/10; B60L 13/04
See application file for complete search history.

(56) References Cited

U.S. PATENT DOCUMENTS 1,752,432 A * 4/1930 Hepburn ..... F27D 3/0024 198/663
1,774,338 A * 8/1930 Sos ..... B61B 13/125 104/166
3,727,746 A * 4/1973 Slusher ..... B65G 33/02 198/659
3,808,980 A * 5/1974 Winiarski ..... B61B 13/125 198/677
3,811,385 A * 5/1974 Johnson ..... B66B 21/12 104/167
3,866,538 A * 2/1975 Forsey, Jr. ..... B66B 23/02 104/167

(Continued)

FOREIGN PATENT DOCUMENTS

CN 1880209 A * 12/2006
CN 107323469 A * 11/2017 ..... B61B 13/12

(Continued)

*Primary Examiner* — S. Joseph Morano
*Assistant Examiner* — Maxwell L Meshaka
(74) *Attorney, Agent, or Firm* — Volpe Koenig

(57) ABSTRACT

A propulsion system is disclosed herein that includes a helical track or guideway, and a vehicle or vessel that travels along the guideway. Propellers are provided that are rotationally driven to propel the vessel along the guideway using propulsion, based on physical, magnetic or other means.

40 Claims, 15 Drawing Sheets

(56) References Cited

U.S. PATENT DOCUMENTS

| | | | | |
|---|---|---|---|---|
| 6,668,732 | B2 * | 12/2003 | Di Napoli | E01B 25/10 104/118 |
| 8,720,669 | B2 * | 5/2014 | Iba | B65G 35/066 198/666 |
| 10,508,004 | B2 * | 12/2019 | Fargo | B66B 1/36 |
| 2003/0127256 | A1 * | 7/2003 | Di Napoli | B61B 13/04 180/7.2 |
| 2003/0137377 | A1 | 7/2003 | Engel | |
| 2014/0069780 | A1 * | 3/2014 | Iba | B61B 13/125 198/750.1 |
| 2017/0327347 | A1 | 11/2017 | Fargo | |
| 2017/0343314 | A1 | 11/2017 | Hartman et al. | |
| 2024/0326604 | A1 * | 10/2024 | Farias Serra | B60L 13/04 |
| 2025/0033676 | A1 * | 1/2025 | Farias Serra | B60L 13/04 |

FOREIGN PATENT DOCUMENTS

| | | | | |
|---|---|---|---|---|
| CN | 113898737 | A * | 1/2022 | B60L 13/04 |
| EP | 0144478 | A1 * | 6/1985 | B61B 13/125 |
| WO | WO-8000559 | A1 * | 4/1980 | B65G 33/02 |
| WO | WO-2023009837 | A1 * | 2/2023 | E01B 25/30 |

* cited by examiner

PROPULSION SYSTEM INCLUDING PROPELLERS

CROSS REFERENCE TO RELATED APPLICATION

This application claims the benefit of U.S. Provisional Application No. 63/281,232, which was filed Nov. 19, 2021 and is incorporated herein by reference as if fully set forth.

FIELD OF INVENTION

This application is generally related a propulsion system, and more specifically directed to a propulsion system including a track or guideway, and a moving object, such as a vehicle or vessel.

BACKGROUND

Wheel propulsion systems and magnetic propulsion systems are generally well known. Many types of applications can rely on magnetic propulsion systems, such as guideways, trains, monorails, personal rapid transit (PRT), and other vehicle or package-moving systems. Magnetic propulsion systems can rely on electromagnetic properties to provide drive or propulsion to a vehicle or vessel. Some known magnetic propulsion systems require complex or complicated coils that must be energized in order to provide propulsion.

Providing power or energy to these coils or other aspects of known magnetic propulsion systems can be complicated, energy inefficient, or otherwise undesirable.

Propulsion by wheels generally takes two forms: high-friction systems such as rubber tires on surfaces such as asphalt or cement, and low-friction systems, such as metal wheels on metal rails, as in the case of trains.

High-friction systems are limited in their energy-efficiency and even speeds, and low-friction systems are limited in their traction and therefore in their capacity for traveling along steep grades. It is desirable to have a propulsion system that can generate low friction and can travel along steep grades while achieving high speeds.

SUMMARY

A propulsion system is disclosed herein that includes a helical track or guideway, and a vehicle or vessel that travels along the guideway. Propellers are provided that are rotationally driven to propel the vessel along the guideway, preferably based on magnetic propulsion. As the propeller blades rotate, force components are generated that propel the vessel along the guideway. Various configurations are disclosed herein.

In an aspect, the invention relates to a propulsions system comprising a track assembly and a vessel assembly. The track assembly comprises a guideway. The guideway comprises at least one helical rail and an internal space. The vessel assembly comprises at least one propeller, each propeller comprising at least one blade. The guideway and each blade are engaged through a low friction coupling. Propulsion and suspension of the vehicle results at least partly from interactions between the at least one blade and the at least one helical rail, and the vessel assembly is configured to move within the internal space.

In an aspect, the invention relates to a method of propulsion of a vessel assembly. The method comprising rotating at least one propeller on the vessel assembly, which is part of a propulsion system. The propulsions system comprising a track assembly and the vessel assembly. The track assembly comprises a guideway. The guideway comprises at least one helical rail and an internal space. The vessel assembly comprises at least one propeller, each propeller comprising at least one blade. The guideway and each blade are engaged through a low friction coupling. Propulsion and suspension of the vehicle results at least partly from interactions between the at least one blade and the at least one helical rail, and the vessel assembly is configured to move within the internal space.

BRIEF DESCRIPTION OF THE DRAWINGS

The foregoing Summary as well as the following Detailed Description of embodiments of the invention will be best understood when read in conjunction with the appended drawings. In the drawings.

DETAILED DESCRIPTION

Figure 1:
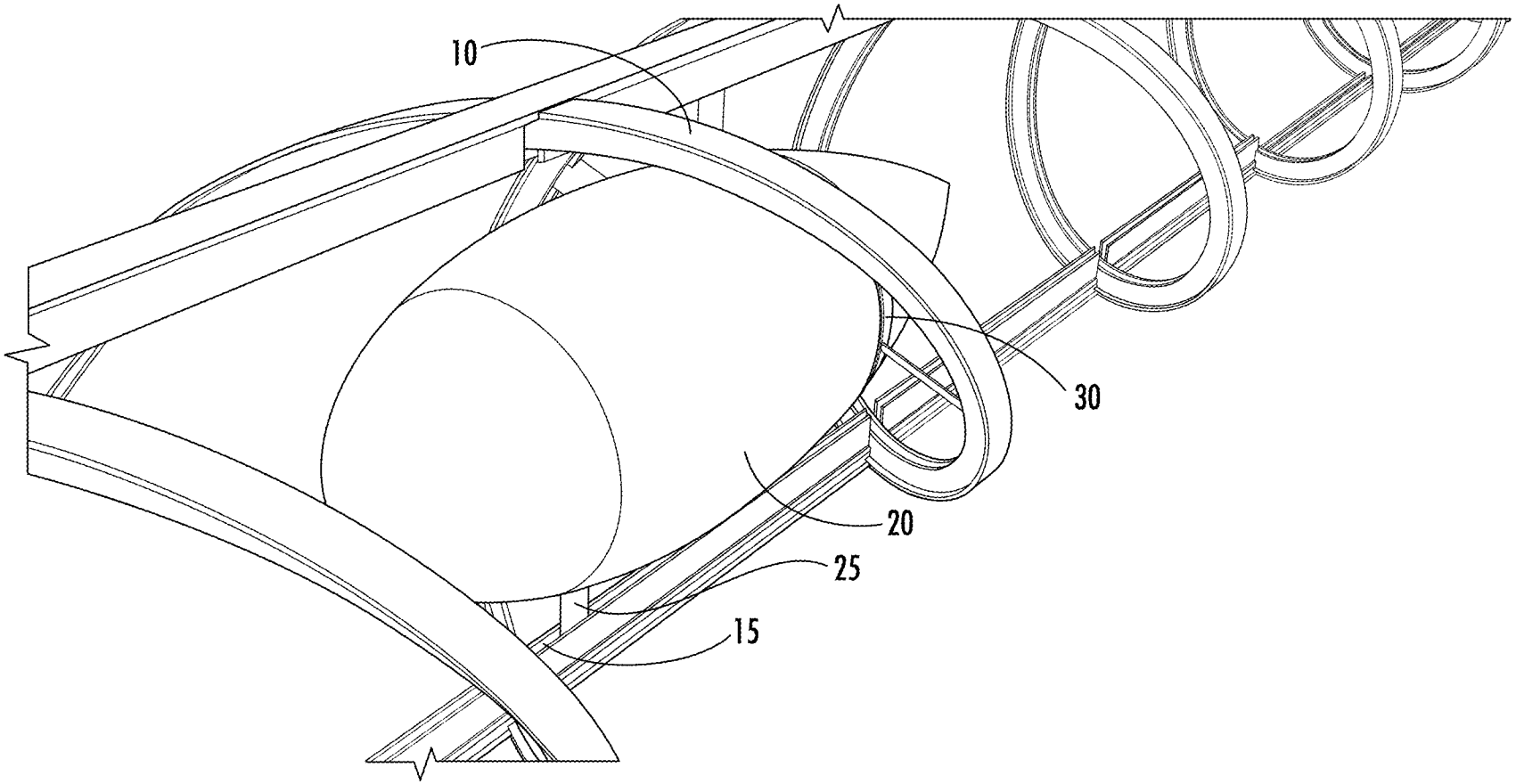
FIG. 1 illustrates a perspective view of an embodiment of a propulsion system.
Figure 2:
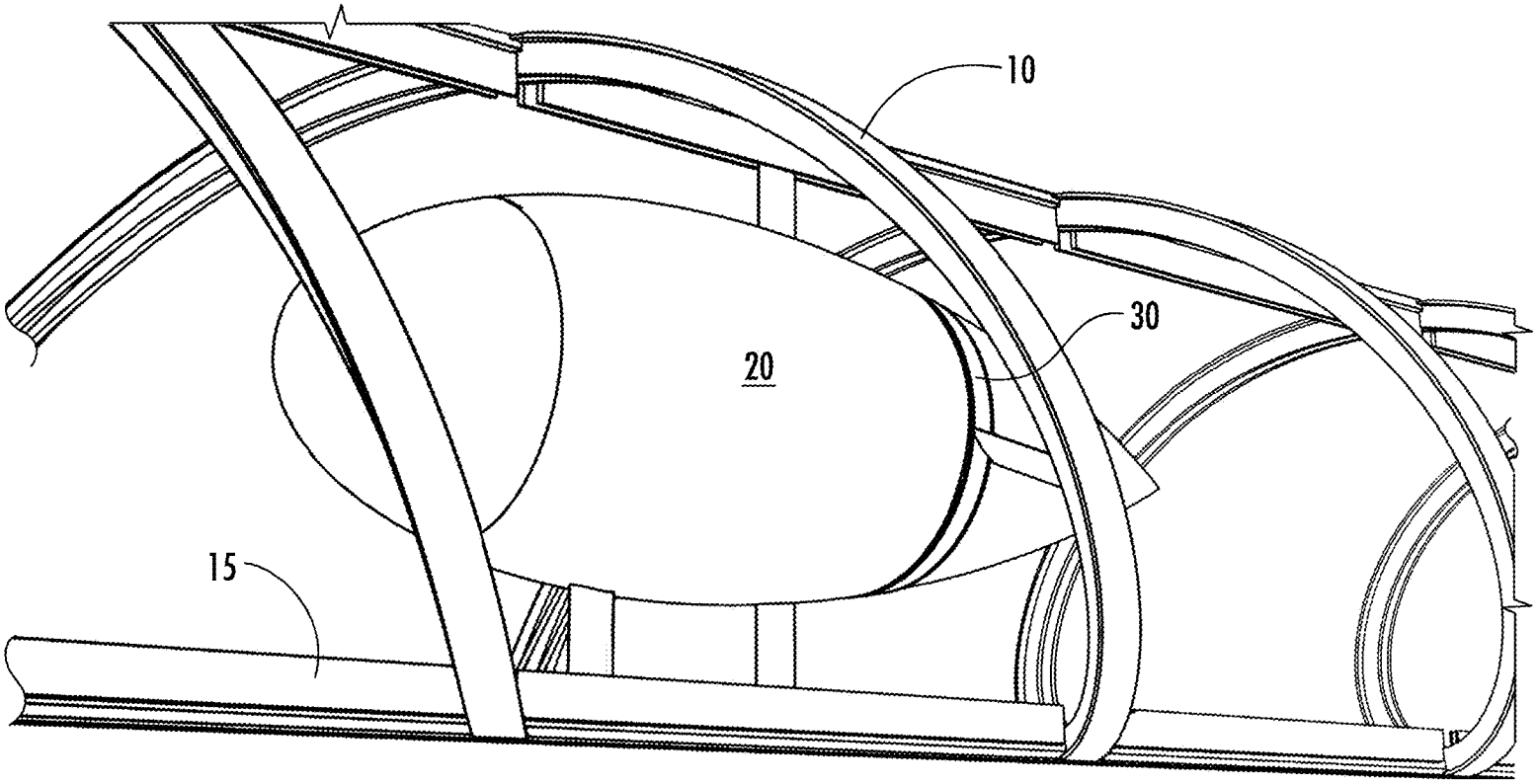
FIG. 2 illustrates another perspective view of the propulsion system of FIG. 1.
Figure 3:
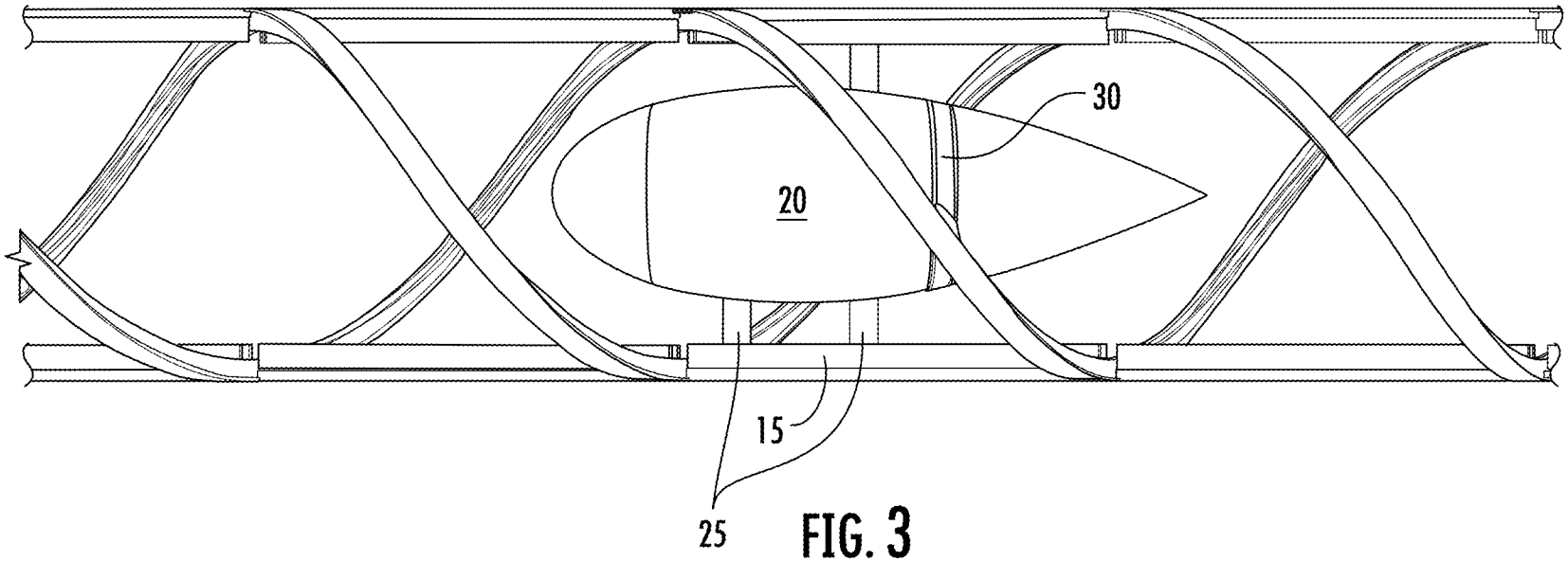
FIG. 3 illustrates a side view of the propulsion system of FIGS. 1 and 2.
Figure 4:
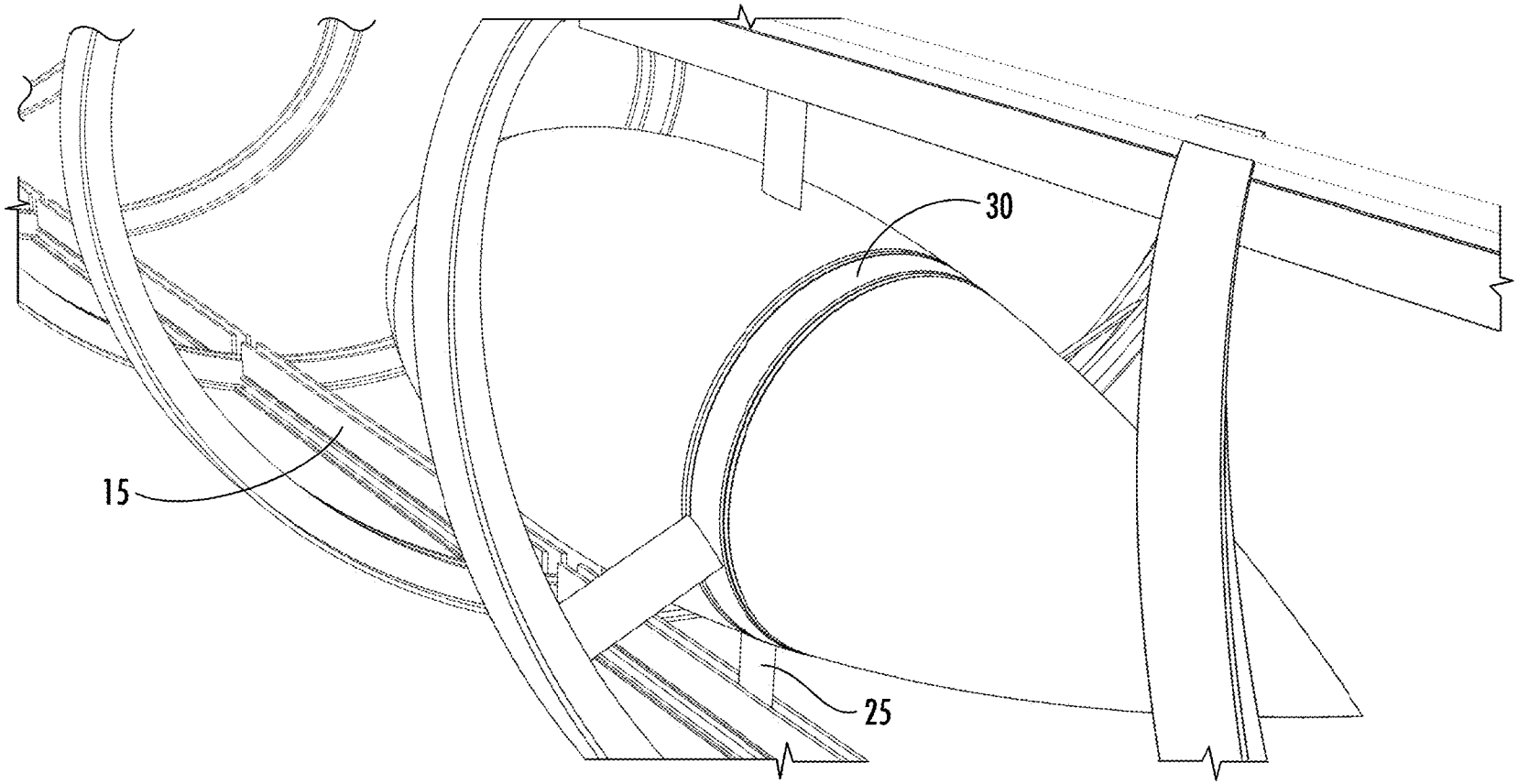
FIG. 4 illustrates a magnified view of an interface between propellers and a guideway.

It would be desirable to provide a propulsion system that is at once energy-efficient, capable of fast travel speeds and capable of high traction to travel along steep grades.

An embodiment comprises a propulsion system that includes a helical track assembly, comprising at least one guideway, and a vessel assembly that travels along the guideway. The at least one guideway may be helical. The guideway may comprise or be one or more helical rails. The vessel assembly may be but is not limited to a passenger vehicle, a cargo vehicle, or a vehicle that may accommodate both passengers and cargo. The vessel assembly may comprise a shuttle. The vessel comprising a shuttle may also comprise a passenger vehicle, a cargo vehicle, or a vehicle that may accommodate both passengers and cargo in combination with the shuttle.

The vessel assembly may comprise at least one propeller, the at least one propeller is/are rotationally driven to propel the vessel assembly along the at least one guideway based on low-friction interfaces between the propellers and the at least one guideway. The low-friction interfaces may be contactless magnetic repulsion or attraction. As the propeller blades rotate, force components are generated that propel the vessel along the guideway and also, force components are generated that suspend the vessel on the guideway. Various configurations are disclosed herein.

In an embodiment, interfaces between the propellers and the guideway(s) are achieved through contactless magnetic attraction and/or repulsion. In another aspect, the interfaces are achieved through physical contact between the parts by means of wheels, bearings or rollers.

In an embodiment, a magnetic propulsion system including a track assembly and a vessel assembly is provided.

The track assembly includes at least one helical guideway. In an example, the helical guideway(s) include a plurality of magnets fixedly arranged thereon. The orientation and disposition of the magnets could vary depending on the application, as appreciated by the skilled artisan. For example, if a Halbach configuration is chosen for the magnets, then the orientations of the polarities of the magnets will not be all the same.

In an embodiment, the track assembly is electrically static. In an embodiment, the electrically static track assembly and does not require a power source. In an embodiment, the track assembly lacks electromagnets. In an embodiment, the track assembly comprises electromagnetic elements.

The vessel assembly may include a motor configured to rotate the at least one propeller. The motor may be internal to the vessel assembly. The motor may be external to the vessel assembly. The external motor may be fixed to the vessel assembly. The motor can be arranged within an interior space defined by a body of the vessel assembly. A motor can be configured to drive a shaft connected to a first gear, and a second gear can be fixed to the at least one propeller. The first gear and the second gear can be matingly engaged with each other to rotate the at least one propeller. Other driving means or systems can be used besides gears, as one of ordinary skill in the art would appreciate.

In an embodiment, a gap is defined between the at least one blade of the at least one propeller, and the surfaces of the at least one helical guideway. In an embodiment, this gap is preferably 100 micrometers to 10 cm. The gap may be 100, 200, 300, 400, 500, 600, 700, 800, 900, or 1000 micrometers, or a value between any two of the foregoing. The gap may be 1, 2, 3, 4, 5, 6, 7, 8, 9, or 10 millimeters, or value between any two of the foregoing. The gap may be 1, 2, 3, 4, 5, 6, 7, 8, 9, or 10 cm, or a value between any two of the foregoing. The gap may be in a range from any low endpoint to any high endpoint, where the low endpoint and high endpoint are selected from any two micrometer increments selected from 100 micrometers to 10 cm, and the low endpoint is less than the high endpoint.

In an embodiment, the vessel assembly comprises spacers or spacing elements on one or more of an external surface of the vessel assembly, an eternal surface of the at least one blade of the at least one propeller, and an internal facing surface of the guideway(s). Alternatively or in addition, bearing components, wheels, rollers, or other interfacing support components can be provided. These elements can be provided for when a centering force generated by rotation of the at least one propeller is insufficient to lift the vessel assembly or force the vessel assembly away from the guideway(s).

Rotation of the at least one blade of the at least one propeller is configured to generate forces on the at least one helical guideway that are perpendicular to the longitudinal axis (X) of the track assembly (i.e., a lifting force or centering force) and parallel to the longitudinal axis (X) of the track assembly (i.e., a thrusting force or propulsion force).

In regions of the track assembly that are generally designated as high-speed portions, the pitch may be greater, and in regions of the track assembly that are generally designated as low speed or docking or loading portions. The pitch may be much lower in order to provide centering force capabilities. Stated differently, the pitch is the distance along the axis of the helix/helices that makes one complete turn. Therefore, in low speed areas, it is desirable to have many turns over a short distance; i.e., a lower pitch.

An embodiment comprises a method of propelling a vessel along a track. The method may operate on any system or device herein.

The method may include rotating one or more propellers that are at least axially supported on a portion of the vessel such that propulsion forces and centering forces are generated, and the vessel is driven along the track. The method may include various other steps, as disclosed herein.

An embodiment comprises a magnetic propulsion system. The magnetic propulsion system comprises a track assembly comprising at least one helical guideway extending along a longitudinal axis of the track assembly and having a plurality of magnets or a magnetic array arranged on a surface of the at least one helical guideway. The system comprises a vessel assembly the comprises at least one propeller, and at least one motor configured to rotate the at least one propeller relative to the longitudinal axis. Rotation of the at least one propeller propels the vessel assembly along the track assembly. The motor can be arranged within an interior space defined by a body of the vessel assembly. The motor can be configured to drive a shaft connected to a first gear, and a second gear can be fixed to the at least one propeller. The first gear and the second gear can be matingly engaged with each other to rotate the at least one propeller. Other driving means or systems can be used besides gears, as one of ordinary skill in the art would appreciate.

In an embodiment, magnets or a magnetic array are arranged along ends of the at least one blade of the at least one propeller.

In an embodiment, the track assembly is electrically static and does not require any power source.

In an embodiment, a helical guideway herein has a U-shaped profile when view in cross-section and a magnetic array can be arranged on the interior faces of the U-shaped profile. The plurality of magnets or the magnetic array may comprise permanent magnets.

In an embodiment, rotation of the at least one propeller is configured to generate a centering force in a direction perpendicular to the longitudinal axis (X) of the track assembly and a propulsion force in a direction parallel to the longitudinal axis (X) of the track assembly.

In an embodiment, a control assembly is configured to provide signals to a motor otherwise described herein. In an embodiment, an energy storage unit can be configured to power the control assembly and the motor. In an embodiment, the control assembly and the energy storage unit are arranged within an interior of the vessel assembly.

In an embodiment, an at least one helical guideway herein includes two helical guideways that are diametrically opposed from each other and extend parallel to each other along the longitudinal axis of the track assembly. In an embodiment, each of the two helical guideways have a respective plurality of magnets or magnetic array arranged on a surface thereof.

In an embodiment, a track assembly herein further comprises suspended supports for holding the helical guideway in place.

In an embodiment, a track assembly herein further comprises lower support rails that extend parallel to the longitudinal axis of the track assembly. In an embodiment, the lower support rails include a magnetic array or magnets, bearing components, or a combination thereof.

In an embodiment, pitch of an at least one helical guideway herein is variable, and includes at least a first track area having a first pitch and at least a second track area having a second pitch, and the first pitch can be smaller or greater than the second pitch.

In an embodiment, a vessel assembly herein comprises bearing components. The bearing components can be incorporated throughout the vessel assembly. For example, at least one axial bearing can be provided for supporting the at least one propeller relative to a body of the vessel assembly in an axial direction and at least one radial bearing can be provided for supporting the at least one propeller relative to the body of the vessel assembly in a radial direction.

In an embodiment, a vessel assembly herein comprises an access element configured to open and close such that a user can enter and exit the vessel assembly. In one example, the access element can be formed as a transparent dome on a front portion of the vessel assembly.

In an embodiment, a vessel assembly herein comprises at least one vessel support provided on a lower half of the vessel assembly, and the track assembly can include at least one lower support rail. In an embodiment, the at least one vessel support and the at least one lower support rail are configured to engage with each other at least during a lower speed state or a rest state.

An embodiment comprises a magnetic propulsion system comprising a track assembly having at least two helical guideways that are diametrically opposed from each other and each extend along a longitudinal axis of the track assembly. In an embodiment, each of the at least two helical guideways comprise a magnetic array or plurality of magnets arranged on an interior surface thereof. The magnetic array or plurality of magnets may comprise permanent magnets. In an embodiment, the magnetic propulsion system comprises a vessel assembly comprising a body defining an interior space, at least one propeller, at least one energy storage unit arranged within the interior space, and at least one motor arranged within the interior space and configured to be powered by the at least one energy storage unit to rotate the at least one propeller relative to the longitudinal axis such that the vessel assembly is propelled along the track assembly via rotation of the at least one propeller. In an embodiment, the motor is configured to drive a shaft connected to a first gear, and a second gear can be fixed to the at least one propeller. In an embodiment, the first gear and the second gear matingly engage with each other to rotate the at least one propeller. In an embodiment, the body of the vessel assembly can define an opening through which the first gear protrudes to engage the second gear. In an embodiment, the vessel assembly includes an access element configured to open and close such that a user can enter and exit the vessel assembly. The access element may comprise a transparent dome on a front portion of the vessel assembly.

In an embodiment, at least one axial bearing is arranged between the at least one propeller and the body of the vessel assembly, and at least one radial bearing is arranged between the at least one propeller and the body of the vessel assembly. In an embodiment, the body of the vessel assembly defines a support surface that defines an interface with the at least one axial bearing.

In an embodiment, a vessel assembly herein comprises a plurality of vessel supports provided on a lower half of the vessel assembly, and the track assembly includes at least one lower support rail. In an embodiment, the plurality of vessel supports are configured to interface with the at least one lower support rail for supporting the vessel assembly during a lower speed state or a rest state.

In an embodiment, a vessel assembly herein comprises a body with a diameter of 1 meter. This can be measured relative to an interior wall of the body, in one example. In another example, this can be the diameter as measured relative to an outer wall of the body.

An embodiment comprises a method of propelling a vessel assembly along a track assembly. The method can include multiple steps. For example, the method may comprise providing a track assembly including a magnetic array fixed along at least one helical guideway. The method can include positioning a vessel assembly within an interior track defined by the helical guideway. The vessel assembly can include at least one propeller that surrounds a body of the vessel assembly. The method can include rotationally driving the at least one propeller such that at least a propulsion force is generated via interaction of the at least one propeller with the magnetic array and the vessel assembly is propelled along the track assembly.

A method of propelling a vessel assembly may comprise rotating a propeller of a vessel assembly herein within a propulsion system herein.

In an embodiment, the position of the vessel along the guideway is precisely determined by the rotation of the at least one propeller. In the places where the vehicle is meant to travel slowly, come to a full stop or accelerate from a stop or a slow speed, the pitch of the helical guideway will be shorter. The shorter pitch will result in a greater leverage force generated by the interaction of the propeller(s) and the guideway rail(s). The greater leverage force is useful for accelerating, decelerating, or maintaining the vessel in one place. Thus, the speed of the vessel and its position can be precisely determined by the rotation of the propeller(s) driven by the motor(s).

In an embodiment, for the purpose of loading and unloading passengers, the vessel may be brought to a stop at the desired place along the guideway by means of rotating and stopping the propeller(s) by means of the motor driving it/them, and a hatch opened to gain access to the interior of the vessel.

Particular non-limiting arrangements are described below.

A system is generally disclosed herein that includes track assembly comprising at least one guideway and at least one vessel assembly configured to move along the at least one guideway. In an embodiment, the vessel assembly(ies) move within an interior space defined by the helical guideway. In an embodiment, a system disclosed herein provides an open-air type rail or guideway system.

In an embodiment, the system does not have a tube-like rail or guide system. This is desirable for multiple reasons, including more affordable to manufacture due to less materials, more light-weight, among other advantages. However, the skilled artisan would understand that the guideway can be modified to have a tube-like guideway in a particular application, and another embodiment, thus, includes a tube-like guideway.

Regarding the vessel assembly, any compartment can be used in which people or materials can be transported. The vessel assembly includes at least one rotating component coupled to the vessel. The rotating component acts as a propulsion feature due to interaction with elements on the guideway. The rotating component is also referred to herein as the rotating propulsion component or element and propeller. The rotating component interacts with the guideway to generate propulsion and/or suspension for the vehicle. In an embodiment, the vessel assembly may contain at least one motor and at least one energy storage device (for example, a battery).

The vessel assembly may comprise a vehicle in which people or materials can be transported and a shuttle coupled to the vehicle. In an embodiment, the shuttle travels within the space defined by the helical guideway and includes the at least one rotating propulsion component. A coupling is provided between the shuttle and the vehicle, which travels outside of the space defined by the helical guideway. In this embodiment, the motor and energy storage unit may be each be contained in the vehicle and/or in the shuttle. Alternatively, the shuttle can be arranged in front of or behind the vessel. This arrangement may be advantageous because the vehicle can have a size that is not restricted by the interior space defined by the guideway. Therefore, the cross-section of the vehicle can be larger than a diameter of the guideway, and also have a different shape than the interior space of the guideway.

The track assembly comprises at least one guideway, which may comprise at least one helical rail. In an embodiment, the at least one helical rail includes one or more congruent and coaxial helical rails. In an embodiment, the at least one guideway can be considered a double helix. Longitudinal axes of the helical rails can coincide with the direction of intended travel of the vehicle.

The at least one helical rail defines an interior space in a radial direction. Within this interior space, the vessel (or at least one of its propulsion and/or suspension components; e.g., a shuttle) is propelled along the longitudinal axis of the at least one guideway. The pitch of the helical rail or rails of the guideway can be continuously variant to regulate the traction and vehicle speed needed for each segment of the guideway. In an embodiment, the vessel is a vehicle dimensioned such that the vehicle fits within the interior space defined by the helix of the at least one guideway.

The vehicle generally interacts with the helical guideway, and generates propulsion and suspension. In an embodiment, propulsion and suspension is generated via at least one rotating element. In an embodiment, the at least one rotating element comprises a propeller. In an embodiment, the at least one rotating element extends outward from the vehicle to the at least one helical rail of the guideway. The at least one rotating element can be or comprise a plank, bar, rod, or other type of extension. At least one portion of the propeller or rotating element may overlap, either inside of or around, a portion of the guideway. In an embodiment, rotation of the at least one rotating element or propeller is driven by a motor contained in the vehicle. The at least one rotating element may comprise two radially extending blades or extensions. The distal or terminal ends (also referred to as propeller tips) of the blades engage or interact with the guideway.

In an embodiment, the propeller tips are arranged in proximity or in contact with the guideway rails to generate forces. In an embodiment, this configuration is similar to the forces generated by the thread of a bolt when driven into a nut.

In an embodiment, the rotating propeller tips react with, and thereby push against the surfaces of the helical rails, such that a reaction force is generated perpendicular to the rail surfaces interacting with the propeller tips. The resulting force can be composed of (1) a force component along the radial axis of the guideway that can be considered a radial force that can be used for centering and suspending the vehicle within the interior space defined by the helical guideway, and (2) a force component along the longitudinal axis of the guideway that can be considered a propelling force that is configured to propel the vehicle along the rails or guideway.

In an embodiment, interaction between the ends of the blades and the rails can include a bearing element. For example, a low-friction coupling can be used, which can include wheels, rollers, and/or magnetic bearings that rely on magnetic attraction and/or magnetic repulsion.

In an embodiment, the distal ends of the propeller blades have rolling elements, such as wheels or rollers, which make physical contact with the rails of the helical guideway. These rolling elements ensure that the propeller blades maintain alignment within the guideway. Further, when the propeller blades are not rotating, these rolling elements ensure stability for the vessel within the guideway. The rolling elements may be placed on the interior face of the rail and/or exterior face of the rail, as well as on the sides of the rail so as to generate radial forces relative to the center of the helix (i.e., centering and suspension) and along the longitudinal axis of the guideway (i.e., propulsion). In an embodiment, the rolling elements may be placed so as to interact with rail faces at directions or orientations that are not perfectly aligned in the radial or longitudinal direction, such that the resulting forces still provide the desired centering/suspension and propulsion according to a specific application. The skilled artisan will understand that various bearing and rolling element configurations could be implemented.

In an embodiment, the interaction between the propeller blade tips and a rail of the at least one guideway can employ magnetic attraction features. In an embodiment, the propeller tips comprise at least one magnet or a plurality of array of magnets which generates a magnetic field on both sides of the rail or a rail component. In an embodiment, the rail is a ferrous metal rail, such that the magnetic force will tend to align the magnets with the rail, and oppose any force tending to move the magnets perpendicularly to the longitudinal local axis of the rail. Such force will result in the propeller tips being held in a relatively stable position relative to the rail but without any physical contact and the resulting friction. This arrangement allows the propeller tips to slide freely along the rail, and thus generate a force with a first component perpendicular to the angle between the travel of the propeller tip and the rail, and a second component radially inward toward the center of the interior space defined by the helical guideway. These forces can be considered the propulsion and centering/suspension forces acting on the vehicle.

In an embodiment, interaction between the propeller blade tips and the rails of the guideway is by means of magnetic repulsion. This configuration can be analogous to an arrangement in which a magnet moves in close proximity to another material, such as aluminum or copper. When a magnet or array of magnets is in close proximity to, and in motion relative to a material such as a plate of aluminum or copper, there is a force generated such that the relative motion of the magnet and plate is counteracted. Hence, one component of the generated force will tend to oppose the relative motion of the plate and magnet in the direction perpendicular to the plate, and another component will tend to oppose the relative motion in the direction of the relative motion and parallel to the plate. Thus, the forces generated can be described as resistance to the relative motion and repulsion in the direction perpendicular to the plate. Likewise, if a linear array of magnets moves in close proximity to, and parallel to the plane of the plate, but such that the longitudinal axis of the array is not parallel to the direction of relative motion, there will be a force generated perpendicular to the longitudinal axis of the array, and parallel to the plane of the plate, tending to oppose its relative motion. Thus, if either the propeller end or the rail include one or more magnet arrays and the corresponding rail or propeller end incorporate aluminum or copper plates to react with the magnets, there will be a force generated perpendicular to the local axis of the array, and parallel to the copper or aluminum plates. This force, according to the shape and design of the arrays, can be directed radially on the propeller to generate a centering force that will maintain the vehicle and its propeller(s) suspended and not in direct contact with the rails.

In an embodiment, the helical guideway rails are configured to have a slit along the rail, facing inward so that the propeller tips travel partially inside the space within the slit. As used in this context, the term slit refers to any type of track, passage, slot, or opening, or multiple tracks, passages, slots, or openings. In this configuration, the magnet arrays are placed on the propeller tips to react with the rail, or placed on the rail, and interact with the propeller tips. In these configurations, the propeller tips interacting magnetically with the two interior surfaces of the rail slit will generate a repulsion force component which will tend to prevent physical contact between the propeller blade and the rail, resulting in propulsion as the propeller rotates, and another repulsion force component parallel to the interior faces of the rail slit and to the exterior surfaces of the propeller tip. This last component can be directed inward, to the central axis of the guideway to produce centering and suspension for the vehicle, by means of the orientation of the magnet arrays on the propeller tips or on the interior faces of the guideway rails. If the at least one magnet array is configured to be at an angle to the tangential direction of relative motion between the propeller tip and rail, the resulting repulsion force will be perpendicular to this angle, and can be decomposed into a drag component, opposing the motion of the propeller tip, and a centering/suspension component in the direction along the radius of the interior space defined by the helical guideway.

In an embodiment, a guideway contains magnets arranged in at least one array on at least the interior face of rails of the guideway, such that the magnets are in close proximity to the propeller tips (i.e. the ends of the rotating elements of the vehicle propulsion system). In this embodiment, the propeller ends include reaction plates, that may include copper or aluminum plates. These reaction plates will rotate in close proximity to the magnets on the guideway rails, and generate force components to center and suspend, as well as propel the vehicle.

In an embodiment, each propeller tip comprises one reaction plate arranged perpendicular to the axis of the propeller blade. In an embodiment, the reaction plates may form one or more continuous belts or strips instead of being formed as separate and discrete plates. In this configuration the belt or strip of reaction plate may be attached to each propeller tip. The one or more continuous belts or strips are configured to rotate inside the space defined by the helical rails of the guideway, in close proximity to them, thereby generating a repulsion force perpendicular to the plate surface and another repulsion force component parallel to the surface of the plate, and perpendicular to the local axis of the rail. The first force component will generate the centering and suspension forces on the vehicle, and the second component will generate the propulsion forces on the vehicle.

In an embodiment, the propeller tips may contain a magnet array or arrays, which would rotate in close proximity to the surfaces of rails of the guideway (which may be formed from aluminum or copper), such that the same forces described above would be generated.

In an embodiment, the propeller tips comprise the slit, and the rail comprises an interior "blade" (i.e., a protrusion, flange, or other extension) such that the slits in the propeller tips enclose the rail blade and generate the same reaction forces described above.

A propulsion system generally disclosed herein has multiple advantages. For example, the system is configured to generate enormous traction, as the propellers act as screws, pushing on the helical guideway and making it possible for the vehicle to propel large loads in any direction, including very steep inclines or declines. Additionally, this system can function at higher speeds, such as several hundreds of kilometers per hour, since the combination of the pitch of the helical guideway and the rotation rate of the propellers can result in high vehicle speeds. As compared to known arrangements, the system disclosed herein provides an open-air helical guideway and avoids issues associated with air compression in enclosed guideway tubes.

Referring to FIGS. 1-5, 6A and 6B, a system is shown including a guideway 10 and a vessel; i.e., vehicle 20. As shown in FIGS. 1-5, 6A and 6B, the guideway 10 is formed as a helical railway. The vehicle 20 is generally arranged in an interior space defined by the guideway 10. At least one propeller 30 is provided that is generally configured to propel the vehicle 20 along the guideway 10. The at least one propeller 30 can include at least one blade or extension that is generally configured to be arranged in proximity to the guideway 10. In an embodiment, the at least one propeller 30 includes a pair of blades arranged on diametrically opposed sides of the vehicle 20. The at least one blade of the propeller 30 can include a magnetic feature, such as at least one magnet, ferrous material plate, etc. The at least one propeller 30 can include a single propeller, or a plurality of propellers.

The guideway 10 can include a centering rail 15. The centering rail 15 can be provided in a predetermined region and a fixed circumferential position. The centering rail 15 is generally configured to ensure that the vehicle 20 does not spin or rotate during travel. The vehicle 20 can include a fin 25 or other type of extension that is generally configured to engage with the centering rail 15. The fin 25 and the centering rail 15 cooperate with each other to prevent the vehicle 20 from rotating or spinning relative to the guideway 10. The centering rail 15 can include a slot, slit, or other type of passage that is generally dimensioned to receive the fin 25 and prevent rotational movement of the fin 25. Bearing components can be provided along an interior surface of the slot formed on the centering rail 15, and/or bearing components can be provided on outer surfaces of the fin 25. There may be more than one centering rail and corresponding fins to interface with the additional centering rail(s).

Figure 5:
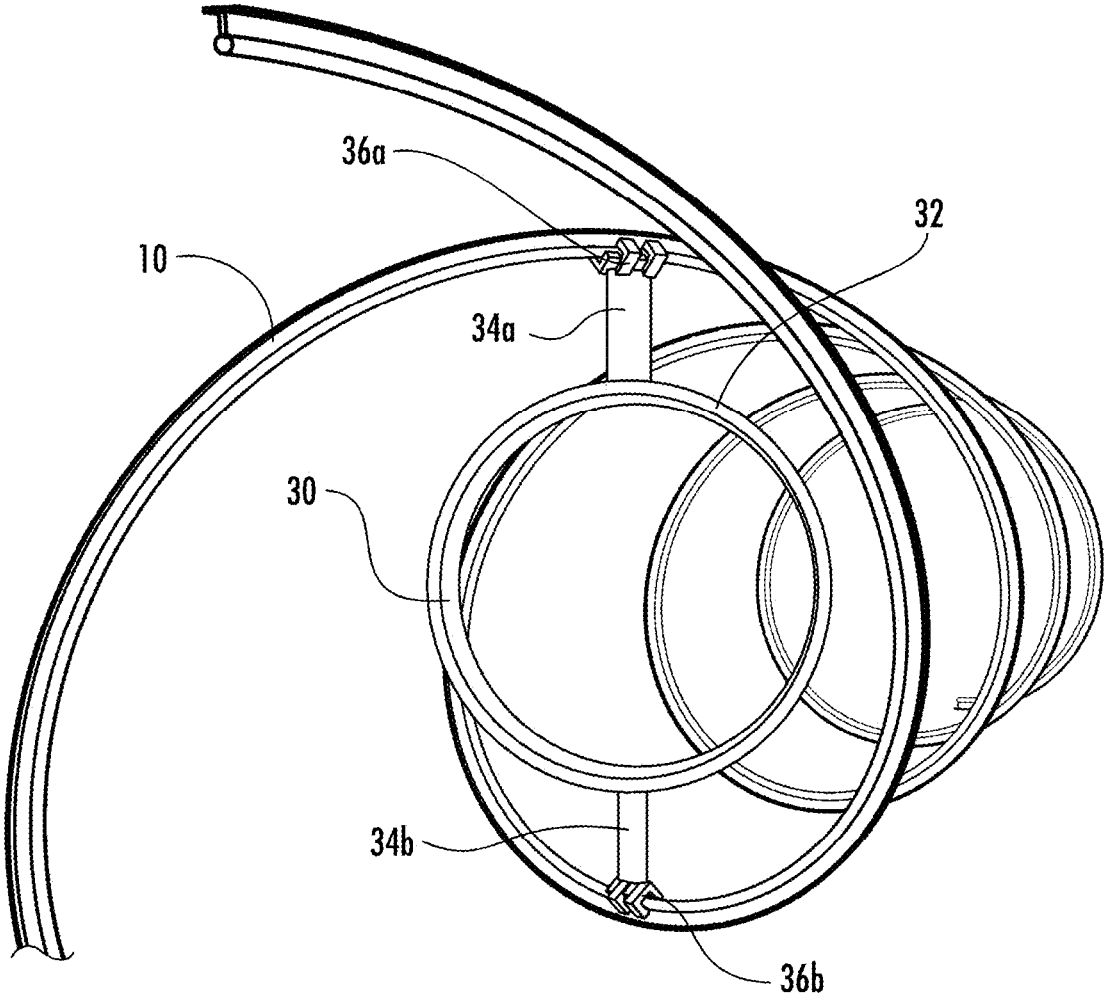
FIG. 5 illustrates a view of the system with the vessel or vehicle omitted for illustrative purposes.

FIG. 5 shows the system with the vehicle 20 omitted for clarity. As shown in FIG. 5, the at least one propeller 30 can include a central ring 32 configured or dimensioned to accommodate the outer surface of the vehicle 20. The propeller 30 can include at least two fins or blades 34*a*, 34*b* that extend radially outwardly. Tips 36*a*, 36*b* of the blades 34*a*, 34*b* are configured to engage with the guideway 10.

In an embodiment, a motor is provided on the vehicle 20 that is generally configured to provide a rotational force or motion to the propellers 30. See FIGS. 16 and 17 with exemplary motors. In an embodiment, the motor includes a stator and the propellers 30 act as rotors of the motor. The motor can be arranged inside or outside of the vehicle 20. A single motor can be provided to drive each of the propellers 30 simultaneously. Alternatively, a series of motors can be provided that are each configured to drive just one or less than all of the propellers 30. In an embodiment, a controller is provided for a motor that is configured to selectively provide a specific amount of rotational input, motion, or force to one or more of the propellers 30.

Figure 6A:
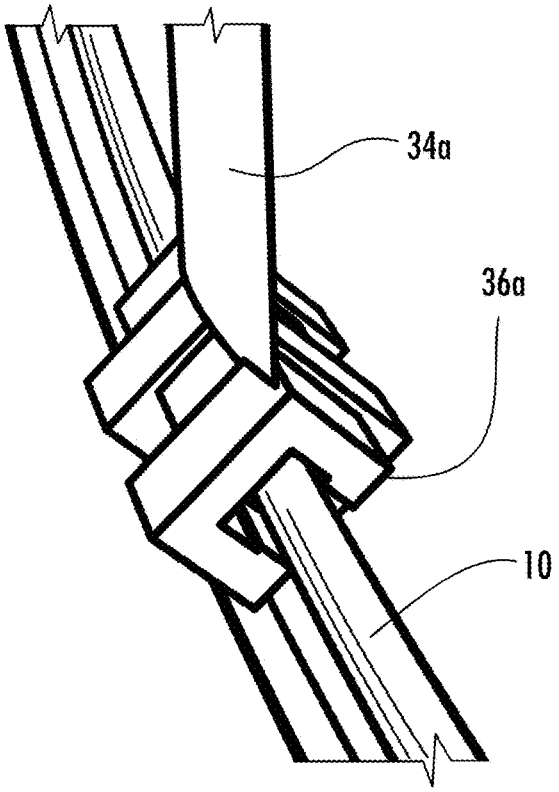
FIGS. 6A and 6B illustrate a magnified view of an interface between a propeller blade and guideway according to one embodiment.
Figure 6B:
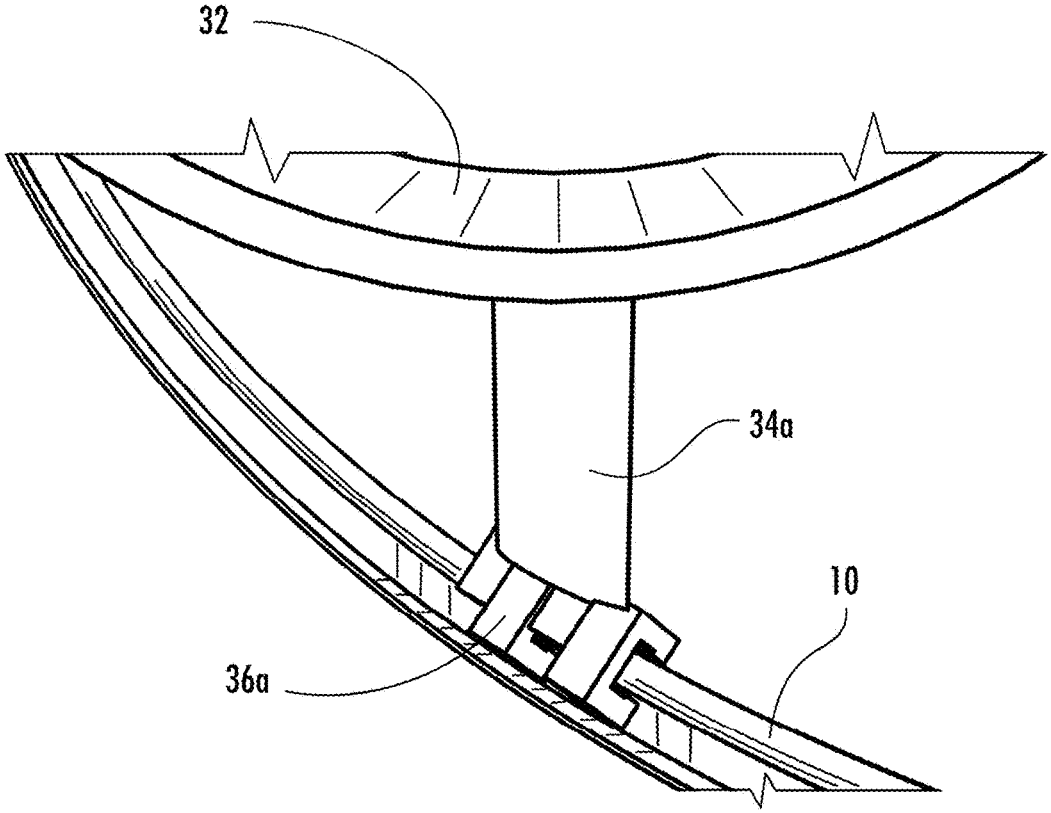

FIG. 6 shows a magnified view of the tips 36*a*, 36*b* of the blades 34*a*, 34*b*. As shown in FIGS. 6A and 6B, the tips 36*a*, 36*b* include a first mating component and the guideway 10 includes a second mating component. As used in this context, the term mating component refers to a complementary profile or mating configuration. For example, the tips 36*a*, 36*b* can include a U-shaped magnetic element, and the guideway 10 can include a protrusion having a magnetic element that is dimensioned to be received within the U-shaped profile of the tips 36*a*, 36*b*. The skilled artisan will understand that a reverse configuration could be provided in which the guideway 10 includes a U-shaped profile or channel with a magnetic element and the tips 36*a*, 36*b* include a protrusion or extension having a magnetic element dimensioned to be received within the U-shaped profile or channel of the guideway 10. Exemplary magnetic orientations may be S for tips and N for guideway, or vice versa.

Figure 7A:
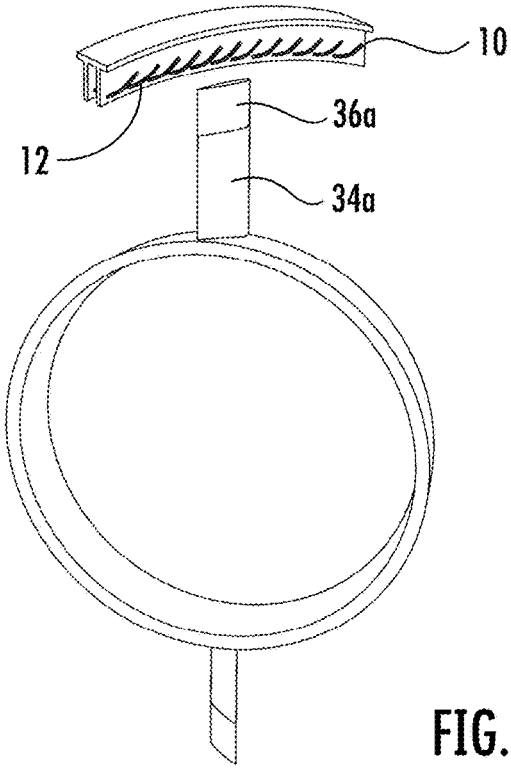
FIG. 7A illustrates a first view of a propeller and portion of a guideway.
Figure 7B:
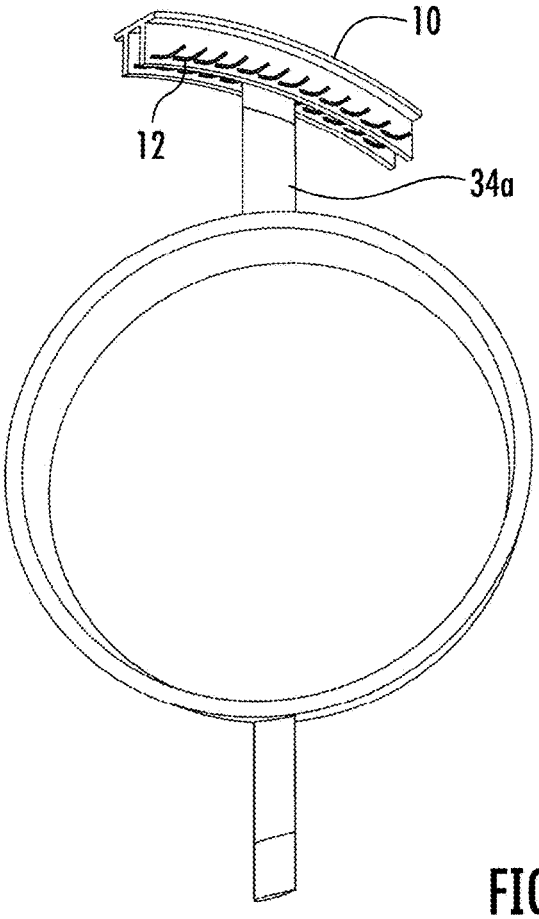
FIG. 7B illustrates a second view of the propeller and portion of the guideway of FIG. 7A.

FIG. 7A illustrates an embodiment in which magnets 12 are arranged on the guideway 10 and the blades 34*a*, 34*b* include tips 36*a*, 36*b* configured to interact with the magnetic elements of the guideway 10. In an embodiment, the tips 36*a*, 36*b* include copper tips. The skilled artisan will understand that various metals or other materials or magnets could be arranged on the tips 36*a*, 36*b*. FIG. 7B illustrates the tips 36*a*, 36*b* inserted within the slot of the guideway 10 and interacting with the magnets 12. Although a plurality of discrete magnets 12 in a curved configuration are shown in FIGS. 7A and 7B, the skilled artisan will understand that alternatively, different curvatures, straight configurations, or a continuous strip or belt of magnetic elements can be provided on the guideway 10.

Figure 8:
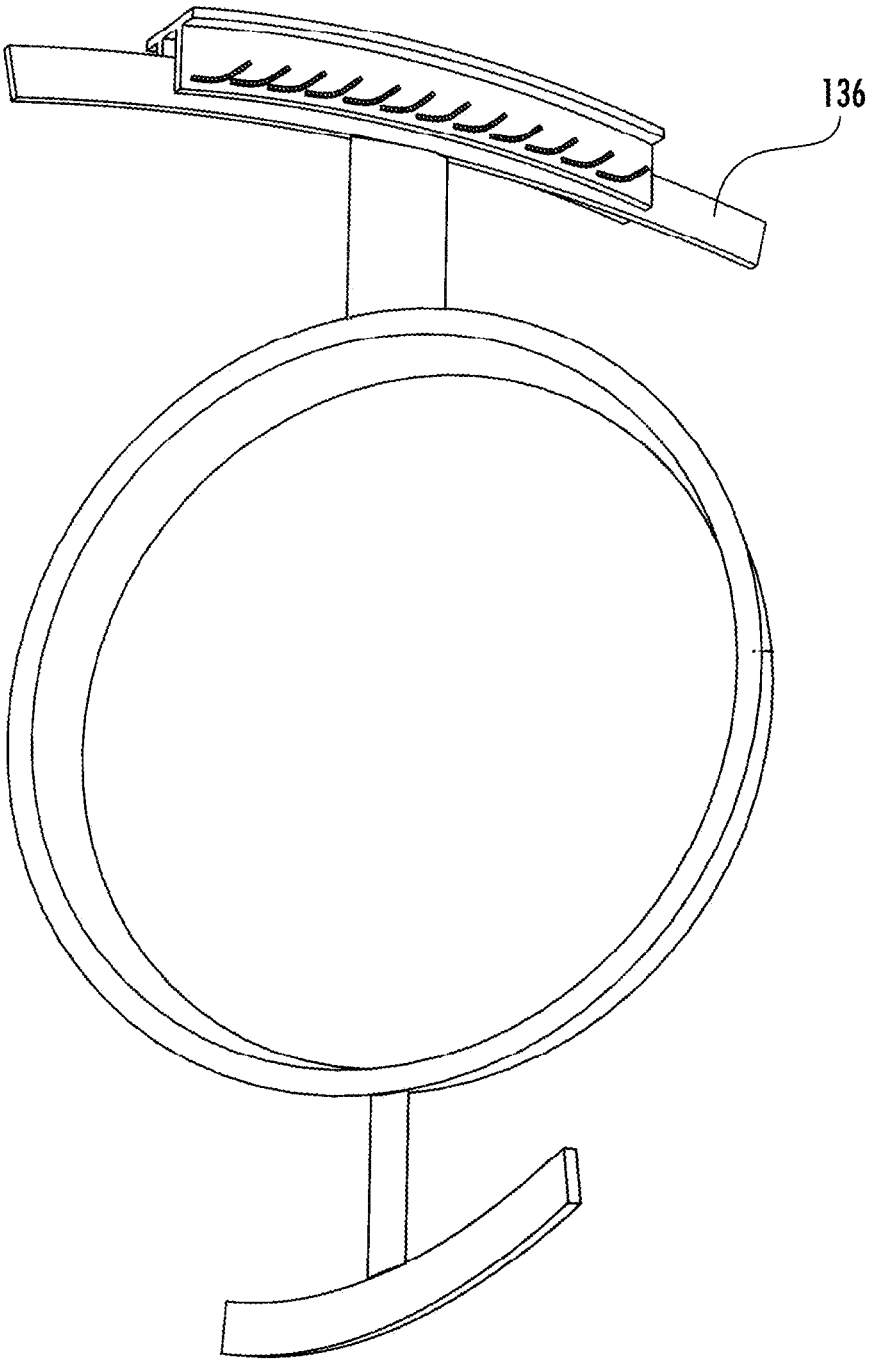
FIG. 8 illustrates a view of the propeller and guideway interface according to an embodiment.

FIG. 8 illustrates another embodiment in which the tips 136 of the blades have an extended or elongated profile. As shown in FIG. 8, the tips 136 extend in a lateral direction from the blades of the propeller. This arrangement provides enhanced surface area relative to the magnets on the guideway 10. The extent of the tips 136 can vary. In an embodiment, a length or extent of the tips 136 can be at least 10% of an entire circumference of the propeller. The length or extent of the tips 136 can be anywhere from 1%-180% of an entire circumference of the propeller for arrangements in which two blades are provided.

Figure 9:
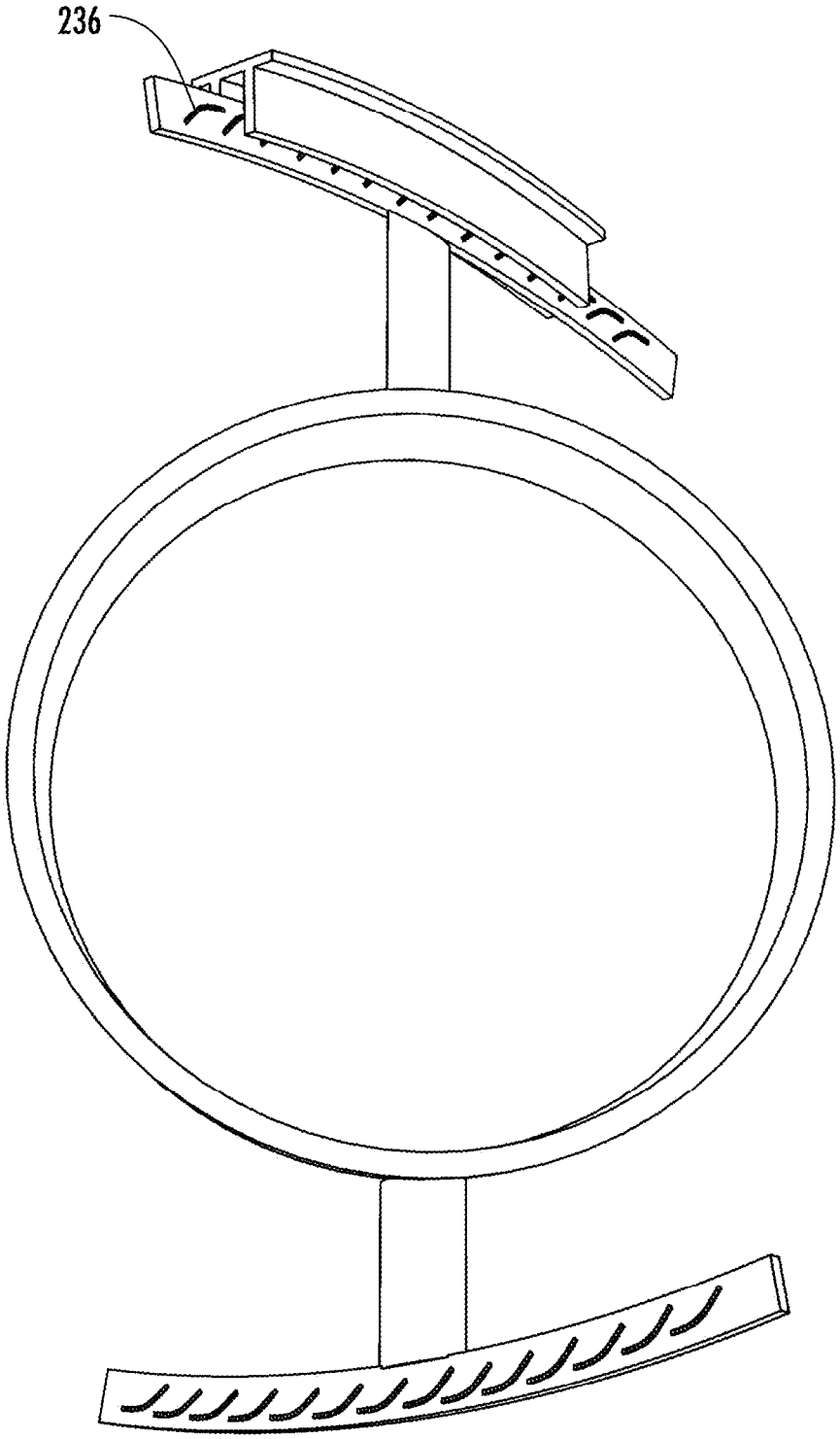
FIG. 9 illustrates another view of the propeller and guideway interface according to an embodiment.

FIG. 9 illustrates an embodiment in which the tips 236 of the blades include a magnetic element, such as a magnetic array or strip or belt of magnets. In this configuration, the guideway 10 includes a material configured to interact with the tips 236.

Figure 10:
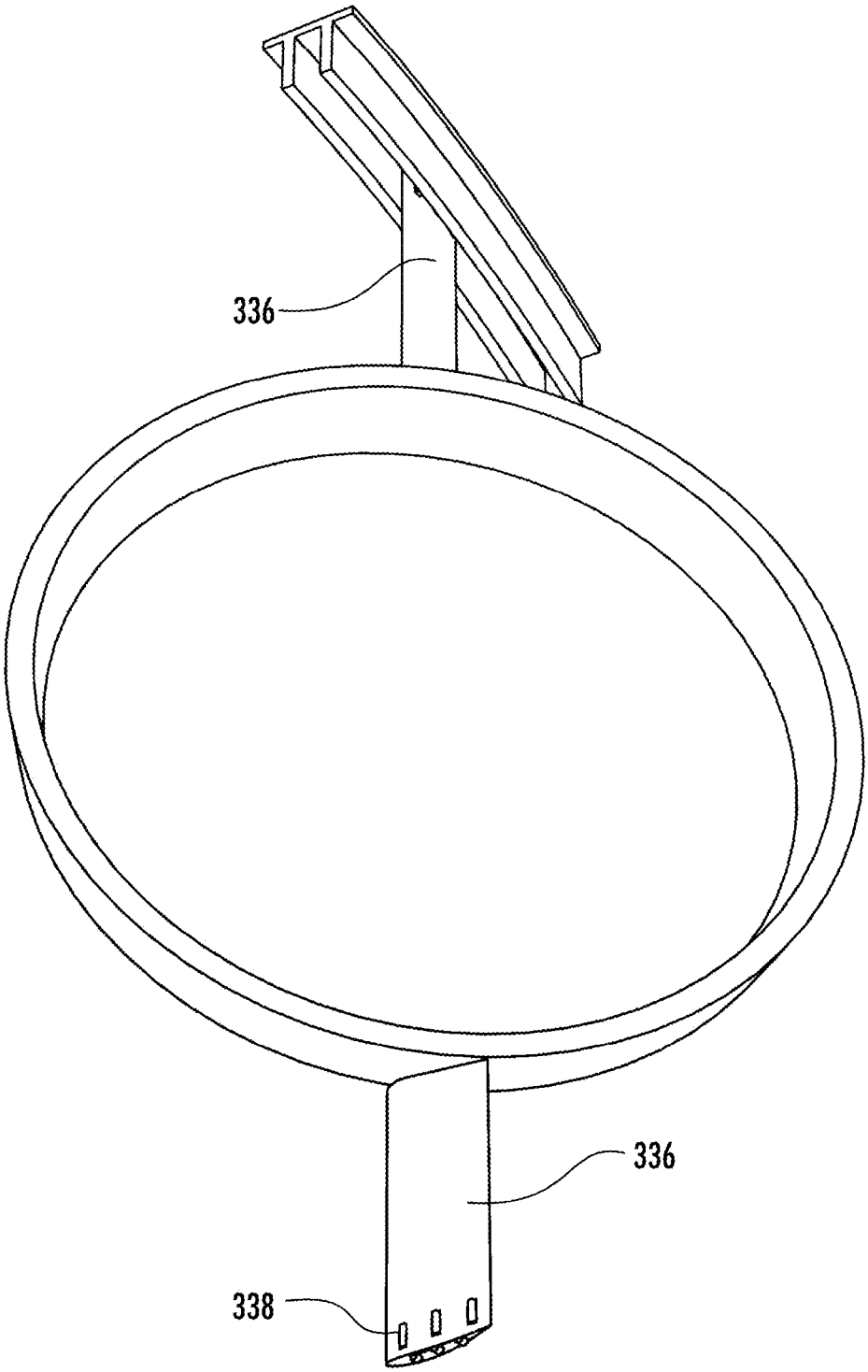
FIG. 10 illustrates a view of a bearing element for the interface between the propeller and guideway according to an embodiment.

FIG. 10 illustrates an embodiment in which the tips 336 include a bearing element 338, such as a plurality of rolling elements or rollers. This arrangement provides a configuration in which physical contact between the propeller tips and the rails is supported by the bearing element 338.

Figure 11:
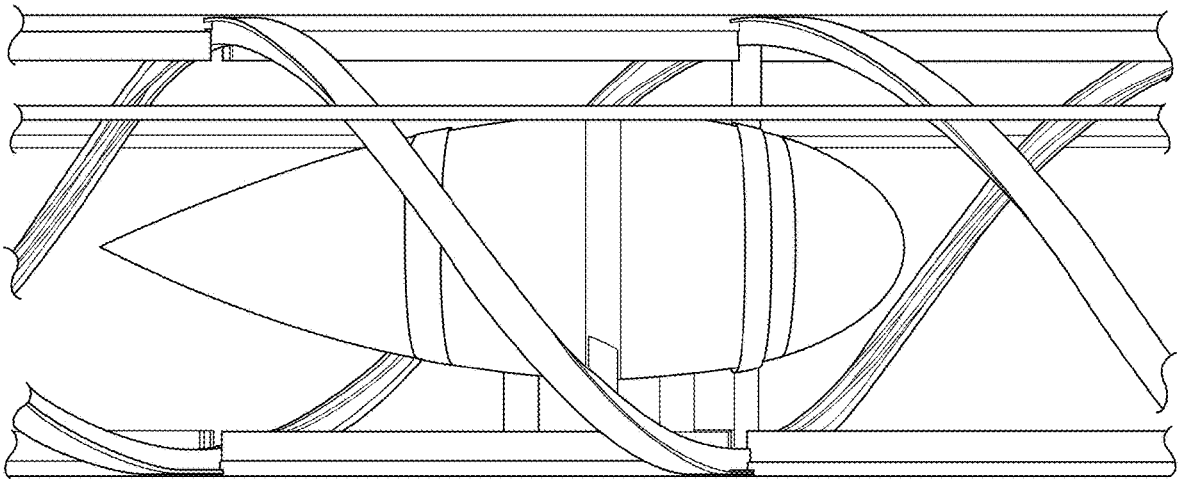
FIG. 11 illustrates a side view of an embodiment of a propulsion system.

FIG. 11 illustrates a side view of an embodiment of a propulsion system. There are three propellers and threes additional fins for additional support of the vessel.

Figure 12:
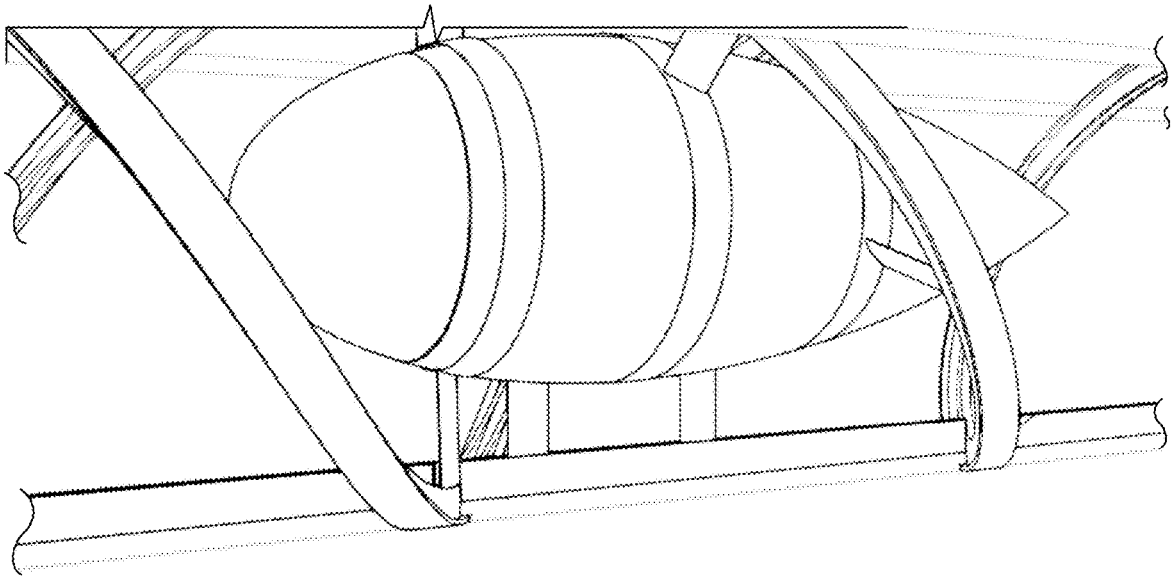
FIG. 12 illustrates a perspective view of an embodiment of a propulsion system.

FIG. 12 illustrates a perspective view of an embodiment with three propellers.

Figure 13:
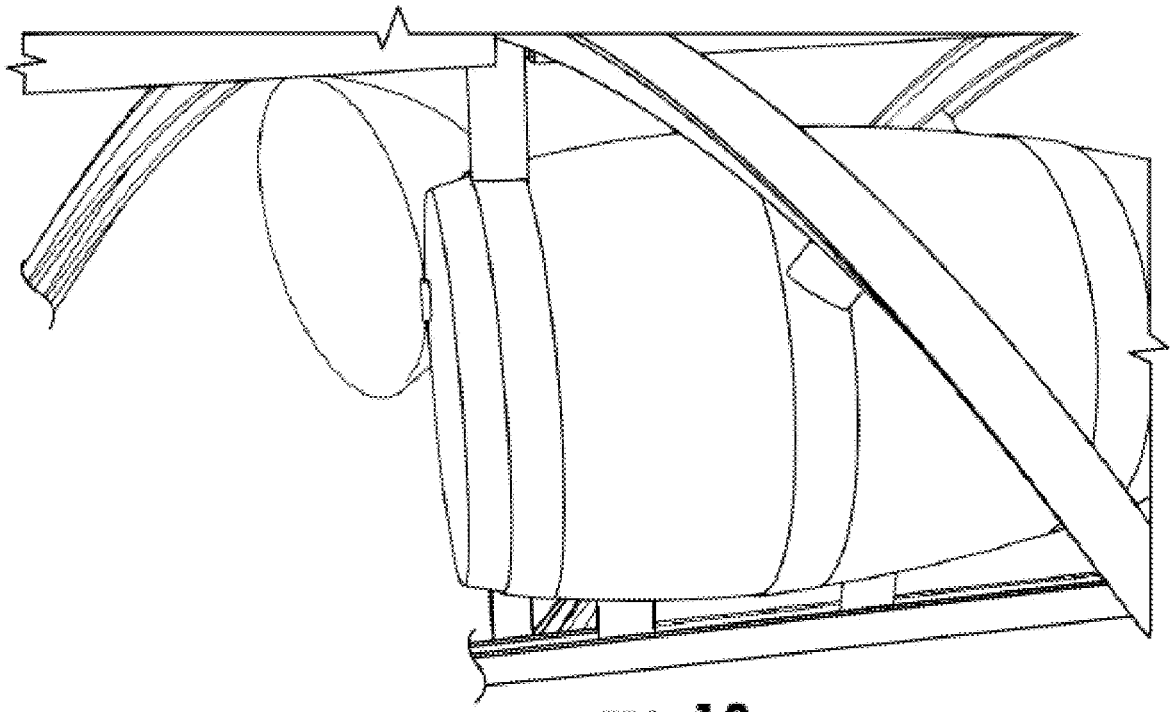
FIG. 13 illustrates an embodiment of a door or hatch for a vessel in an open position.

FIG. 13 illustrates an embodiment of a door or hatch for a vessel in an open position.

Figure 14:
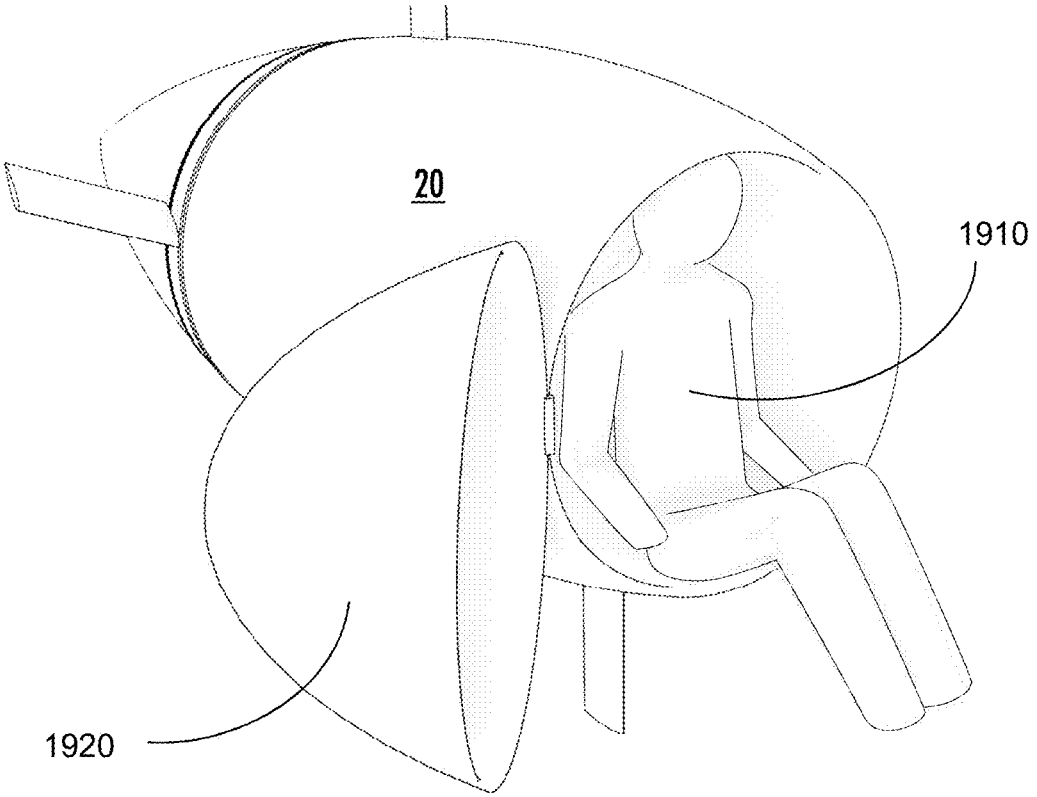
FIG. 14 illustrates an embodiment of a vessel with a door open and a user.
Figure 15:
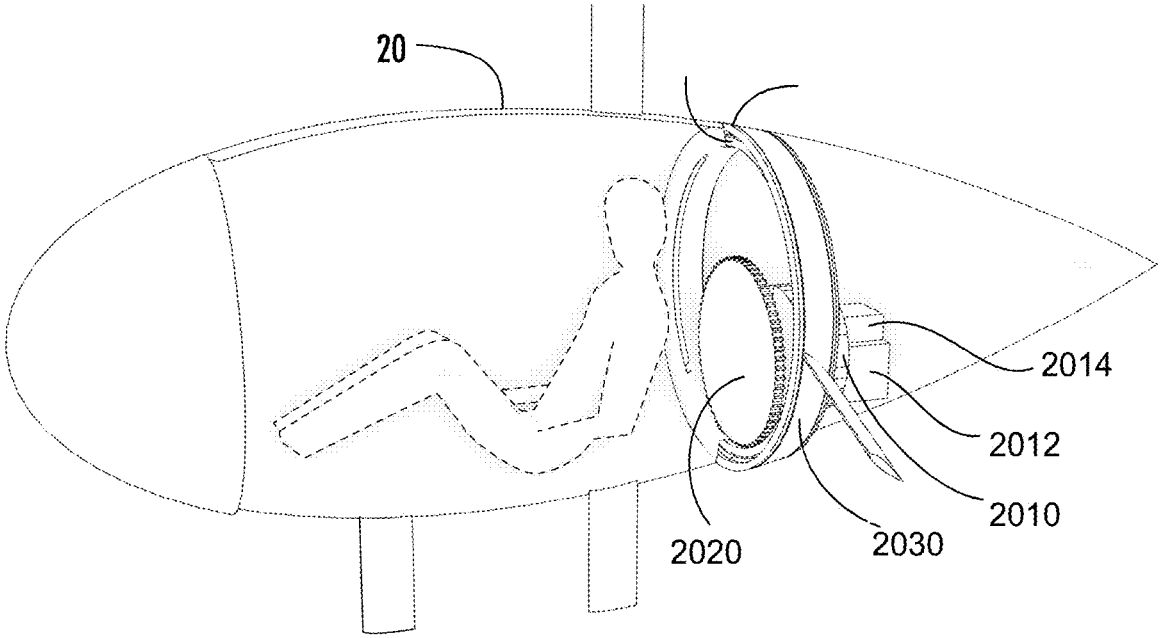
FIG. 15 illustrates an embodiment of a vessel with a passenger, user, inside.

Referring to FIGS. 14 and 15, a user 1910 is illustrated in FIG. 14 partially inside a vessel with a hatch, or door, 1920 in an open position. In FIG. 15, the user is fully inside the vessel and the hatch is in a closed position.

Figure 16:
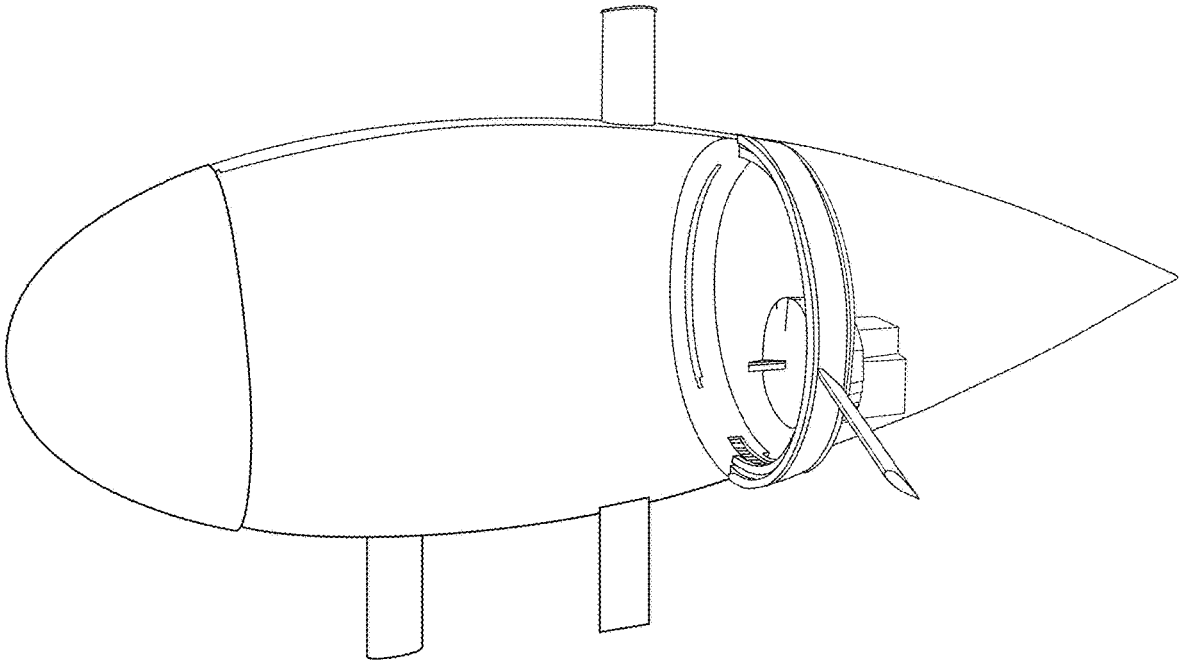
FIG. 16 illustrates a vessel with a cut-away or transparency to reveal a propulsion means therein.
Figure 17:
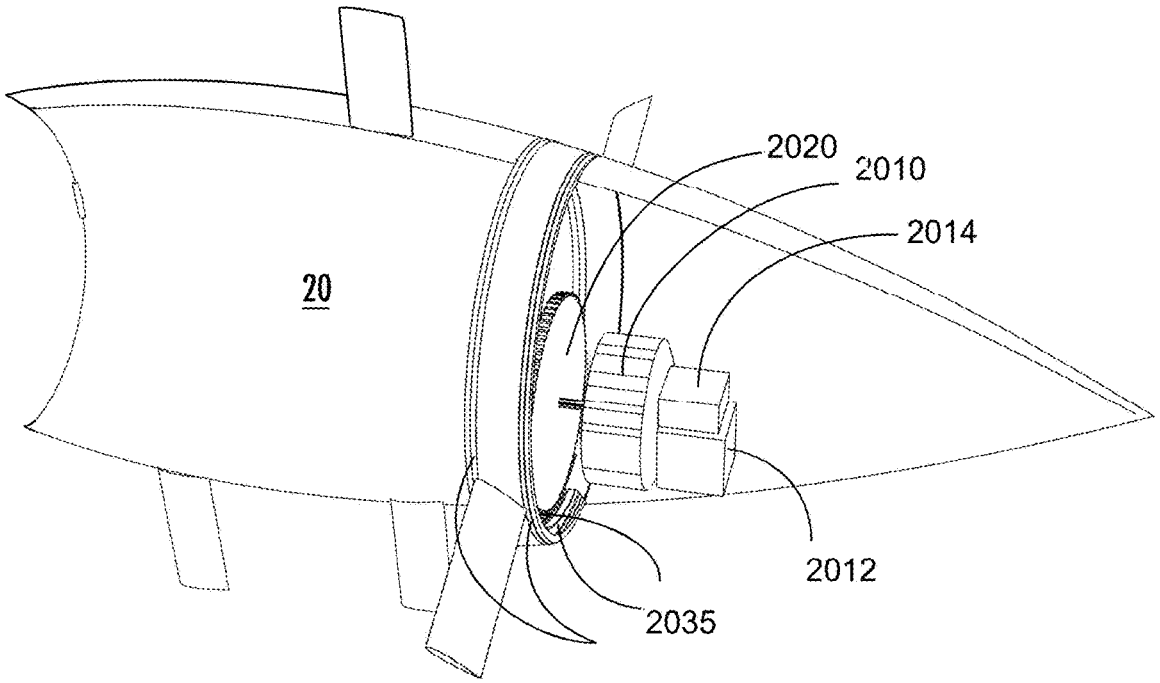
FIG. 17 illustrates a motor in a vessel.
Figure 18:
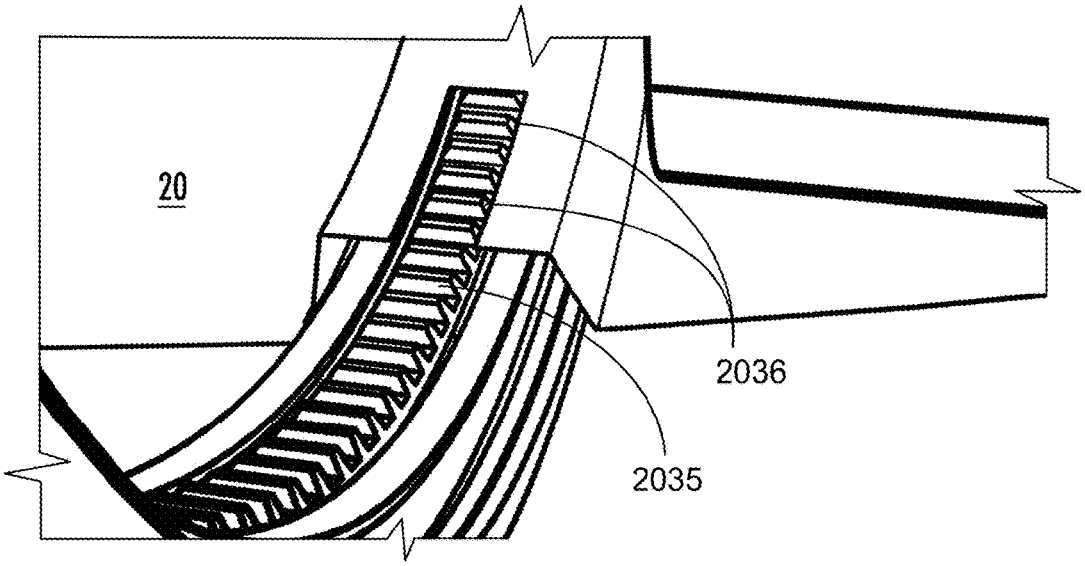
FIG. 18 illustrates a geared engagement on a propeller.

Referring to embodiments in FIGS. 15, 17, and 18, a motor and a gear engaging a propeller are illustrated. A motor 2010 can be configured to drive a shaft connected to a first gear 2020, and a second gear 2035 can be fixed to the at least one propeller 2030. The first gear 2020 and the second gear 2035 can be matingly engaged with each other to rotate the at least one propeller 2030. Other driving means or systems can be used besides gears, as one of ordinary skill in the art would appreciate. A controller box 2014 is illustrated. The controller box may be operably connected to one or more of the motor, the door, or user controls. In an embodiment, the controller box 2014 is configured to receive signals from one or more of a control server and control beacons. The signals may be received via wireless transmission. The control box 2014 may comprise a wireless transmit/receiving unit configured to receive the signals or send signals providing vessel information to a traffic control system, optionally to the server. The controller box may comprise a processor, RAM, a memory, and processor executable instructions stored in the memory. The processor executable instructions may include instructions for propelling the vessel. The processor executable instructions may include instructions for processing signals received from one or more of the control server or control beacons, and propelling the vessel based on the signals. In an embodiment, the control box 2014 is operably connected to user controls and responds to user operation of the controls to propel the vessel and/or open or close the door. In the embodiment illustrated, a battery 2012 is below controller box 2014. FIG. 18 illustrates an embodiment where a gap 2036 through which the first gear engages the second gear. The battery may power one or both of the control box or motor. FIG. 16 also illustrates an embodiment of motor, propeller, and engagements between them.

EMBODIMENTS LIST

The following list is exemplary. Embodiments otherwise described herein are not excluded from the scope of this disclosure even if not specifically recited in the following list.

1. A propulsions system comprising:

a track assembly and a vessel assembly, the track assembly comprising a guideway, the guideway comprising at least one helical rail and an internal space, and the vessel assembly comprising at least one propeller, each propeller comprising at least one blade, wherein the guideway and each blade are engaged through a low friction coupling, propulsion and suspension of the vehicle results at least partly from interactions between the at least one blade and the guideway, and the vessel assembly is configured to move within the internal space.

2. The propulsion system of embodiment 1, wherein the at least one blade has a variable pitch, the variable pitch configured to engage angles of the guideway depending on guideway rail pitch.

3. The system of one or both of embodiments 1 or 2, wherein the at least one propeller has an axis of rotation and comprises a second blade, preferably wherein the first blade is opposed to the second blade, on an opposite side of the axis of rotation relative to the second blade.

4. The system of any one or more of embodiments 1-3, wherein a first rail of the at least one helical rail comprises a first slot, and the first blade engages the first slot, and a second rail of the at least one helical rail comprises a second slot and the second blade engages the second slot.

5. The system of any one or more of embodiments 1-3, wherein a rail of the at least one helical rail includes a slot, and a blade of the at least one blade engages the slot.

6. The system of any one or more of embodiments 1-5, wherein the at least one propeller comprises a plurality of propellers arranged at different axial positions along the vessel assembly, each propeller comprising at least one blade.

7. The system of embodiment 6, wherein the at least one blade is two blades.

8. The system of any one or more of embodiments 1-7, wherein the first blade comprises a tip, the tip comprises a first mating component, a helical rail of the at least one helical rail comprises a second mating component, and the first mating component is engaged with the second mating component, and the low friction coupling comprises the first mating component engaged with the second mating component.

9. The system of any one or more of embodiments 1-7, wherein the blade of one or more of the at least one propeller comprises a tip having U-shaped profile that partially surrounds a portion of the guideway, and the low friction coupling comprises the U-shaped profile surrounding a portion of the guideway.

10. The system of any one or more of embodiments 1-7, wherein the blade of one or more of the at least one propeller comprises a tip comprising at least one magnet or magnetic material, the low friction coupling comprising the at least one magnet or magnetic material.

11. The system of any one or more of embodiments 1-7, wherein at least one rail of the at least one helical rail comprises a plurality of separately formed magnets or magnetic material portions, and the low friction coupling comprises the plurality of separately formed magnets or magnetic material portions.

12. The system of any one or more of embodiments 1-7, wherein at least one rail of the at least one helical rail includes a continuous strip of magnets or magnetic material, and the low friction coupling comprises the continuous strip of magnets or magnetic material.

13. The system of any one or more of embodiments 1-7, wherein the blade of one or more of the at least one propeller comprises a tip comprising a plurality of separately formed magnets, and the low friction coupling comprises the plurality of separately formed magnets.

14. The system of any one or more of embodiments 1-7, wherein the blade of one or more of the at least one propeller comprises a tip comprising a continuous strip of magnetic material, and the low friction coupling comprises the continuous strip of magnetic material.

15. The system of any one or more of embodiments 1-7, wherein the blade of each of the at least one propeller comprises a tip comprising a plurality of separately formed magnets, and the low friction coupling comprises the plurality of separately formed magnets.

16. The system of any one or more of embodiments 1-7, wherein at least one bearing element is arranged at an interface between the tips of the blades and the guideway, and the low friction coupling comprises the at least one bearing element.

17. The system of any one or more of embodiments 1-16, wherein the guideway comprises a centering rail and the vehicle comprises a vertical element engaged with the centering rail through a second low-friction coupling, wherein the centering rail and vertical element stabilize the vehicle and prevent the vehicle from rolling along its longitudinal axis.

18. The system of any one or more of embodiments 1-7, wherein the blade of one or more of the at least one propeller comprises a tip comprising at least one magnet, and the guideway comprises at least one ferrous material helical rail, and the low friction coupling comprises the at least one magnet and the at least one ferrous material.

19. The system of any one or more of embodiments 1-18 further comprising at least one motor configured to rotationally drive the one or more of the at least one blade of the at least one propeller, optionally the motor is configured to rotationally drive each of the at least one blade of each of the at least one propeller.

20. The system of embodiment 18, wherein the blade of one or more of the at least one propeller comprises a tip comprising a reaction plate configured to generate propelling force based on interaction with magnets arranged along the guideway.

21. The system of any one or more of embodiments 1-20, wherein the at least one helical rail is an open-air helical rail.

22. The system of any one or more of embodiments 1-21, the guideway comprising at least one non-helical rail, the at least one non-helical rail configured to provide one or more of additional suspension for the vehicle, alignment of the vehicle, and track switching.

23. The system of any one or more of embodiments 1-22, wherein the vessel assembly comprises a vehicle and a shuttle, the vehicle is engaged with the shuttle, the shuttle comprises the at least one propeller and is configured to move within the internal space, and the vehicle is external to the guideway.

24. The system of embodiment 23 further comprising at least one motor configured to rotationally drive the blade of each of the at least one propeller.

25. The system of embodiment 23 or 24, wherein the at least one helical rail is an open-air helical rail.

26. The system of any one or more of embodiments 1-25, wherein the low friction coupling is characterized in that it generates low or no friction, and none or low magnetic drag.

27. The system of any one or more of embodiments 1-26, wherein at least one bearing element, wheel, or gear is arranged at an interface between the tips of the blades and the guideway, the at least one bearing element, wheel, or gear contacts the at least one helical rail, and the low friction coupling comprises the at least one bearing element, wheel, or gear.

28. The system of any one or more of embodiments 1-27, wherein the low friction coupling comprises magnetic repulsion between the blade of one or more of the at least one propeller.

29. The system of any one or more of embodiments 1-7, 19, or 21, wherein the low friction coupling comprises a groove on the end of a blade of the at least one blade of the at least one propeller, magnets on the interior faces of the groove, and the groove engaging one of the at least one helical rail of the guideway, preferably where the low friction coupling comprises a groove on the end of each blade of the at least one blade of each of the at least one propeller, magnets on the interior faces of each respective groove, and each respective groove engaging a respective one of the at least one helical rail.

30. The system of any one or more of embodiments 1-7, 19, or 21, wherein the low friction coupling comprises a groove on the end of the at least one blade of the at least one propeller, and magnets on an exterior face of one of the at least one helical rail, where the groove engages the one of the at least one helical rail, preferably the low friction coupling comprises a groove on the end of each of the at least one blade of each of the at least one propeller, and magnets on the exterior faces of the at least one helical rail, where the each groove engages a rail of the at least one helical rail.

31. The system of any one or more of embodiments 1-7, 19, or 21, wherein the low friction coupling comprises a groove on the at least one helical rail, and magnets on the exterior faces a blade of the at least one blade of the at least one propeller, where the groove engages a tip of the at least one blade of the at least one propeller, preferably the low friction coupling comprises a groove on each of the at least one helical rail, and magnets on the exterior faces of each of the at least one blade of the at least one propeller, where each groove engages a respective end of the at least one blade of the at least one propeller.

32. The system of any one or more of embodiments 1-7, 19, or 21, wherein the low friction coupling comprises a groove on the at least one helical rail, and magnets on the interior faces of the rail, and the groove engages a tip of the at least one blade of the at least one propeller, preferably where the groove engages the end of each of the at least one blade.

33. The system of any one or more of embodiments 1-7, 19, or 21, wherein the low friction coupling comprises magnets on the at least one propeller and magnets on at least one helical rail.

34. The system of any one or more of embodiments 1-28 and 30-34, wherein the low friction coupling comprises magnetic attraction between the at least one propeller and the at least one helical rail.

35. The system of any one or more of embodiments 1-15, 17-26, and 28-34, wherein the low friction coupling comprises no physical contact except for a magnetic mechanism retaining the magnets from contacting other magnets or magnetic metal parts.

36. The system of any one or more of embodiments 1-7, 19, or 21, wherein the low friction coupling comprises at least one C-shaped arrangement of at least one magnet on an end of the at least one blade of the at least one propeller, the arrangement engaging at least one rail of at least one helical rail, preferably where the one rail comprises ferrous metal, optionally where the C-shaped arrangement comprises wheels having rollers, and the rollers of the wheels prevent the magnets from making physical contact with the rail.

37. The system of any one or more of embodiments 1-7, 19, or 21, wherein the low friction coupling comprises at least one rail of the at least one helical rail comprising a ferrous or magnetic metal having a "C" shape profile comprising an array of magnets and engaging the end of the at least one blade of the at least one propeller.

38. The system of any one or more of embodiments 1-37, wherein the guideway is supported and stabilized by a suspension mechanism.

39. The system of embodiment 38, wherein the suspension mechanism comprises one or more of poles, columns, and cables, the poles and columns configured as vertical compression elements and the cables in tension, and the one or more of poles, columns, and cables, the poles and columns configured as vertical compression elements and the cables in tension are connected to the guideway.

40. The system of any one or more of embodiments 25-39, further comprising at least one motor configured to rotationally drive the blades.

41. A method of transport comprising propelling a vessel along a system of any one or more of embodiments 1-40.

42. The method of embodiment 41 further comprising halting the vessel at a point of origin to enable loading one or more of cargo and one or more passengers into the vessel.

43. The method of one or both of embodiments 41 or 42 further comprising propelling the vessel containing the one or more of cargo and one or more passengers to a destination.

44. The method of any one or more of embodiments 41-43 further comprising halting the vessel at a point of destination to enable partial or complete unloading of the vessel.

Having thus described various embodiments of the present system and method in detail, it will be appreciated and apparent to those skilled in the art that many changes, only a few of which are exemplified in the detailed description above, could be made in the adjustable support device according to the invention without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

What is claimed is:

1. A propulsions system comprising:

a track assembly and a vessel assembly, the track assembly comprising a guideway, the guideway comprising at least one helical rail and an internal space, and the vessel assembly comprising at least one propeller, each propeller comprising at least one blade, wherein the guideway and each blade are engaged through a low friction coupling, propulsion and suspension of a vehicle results at least partly from interactions between the at least one blade and the at least one helical rail, and the vessel assembly is configured to move within the internal space.

2. The system of claim 1, wherein the at least one blade has a variable pitch, the variable pitch configured to engage angles of the guideway depending on guideway rail pitch.

3. The system of claim 1, wherein the at least one propeller has an axis of rotation and comprises a second blade, wherein a first blade is opposed to the second blade, on an opposite side of the axis of rotation relative to the second blade.

4. The system of claim 3, wherein a first rail of the at least one helical rail comprises a first slot, and the first blade engages the first slot, and a second rail of the at least one helical rail comprises a second slot and the second blade engages the second slot.

5. The system of claim 1, wherein a rail of the at least one helical rail includes a slot, and a blade of the at least one blade engages the slot.

6. The system of claim 1, wherein the at least one propeller comprises a plurality of propellers arranged at different axial positions along the vessel assembly, each propeller comprising at least one blade.

7. The system of claim 6, wherein the at least one blade is two blades.

8. The system of claim 1, wherein a first blade comprises a tip, the tip comprises a first mating component, a helical rail of the at least one helical rail comprises a second mating component, and the first mating component is engaged with the second mating component, and the low friction coupling comprises the first mating component engaged with the second mating component.

9. The system of claim 1, wherein the blade of one or more of the at least one propeller comprises a tip having U-shaped profile that partially surrounds a portion of the guideway, and the low friction coupling comprises the U-shaped profile surrounding a portion of the guideway.

10. The system of claim 1, wherein the blade of one or more of the at least one propeller comprises a tip comprising at least one magnet or magnetic material, the low friction coupling comprising the at least one magnet or magnetic material.

11. The system of claim 1, wherein the at least one helical rail comprises a plurality of separately formed magnets or magnetic material portions, and the low friction coupling comprises the plurality of separately formed magnets or magnetic material portions.

12. The system of claim 1, wherein the at least one helical rail includes a continuous strip of magnets or magnetic material, and the low friction coupling comprises the continuous strip of magnets or magnetic material.

13. The system of claim 1, wherein the blade of one or more of the at least one propeller comprises a tip comprising a plurality of separately formed magnets, and the low friction coupling comprises the plurality of separately formed magnets.

14. The system of claim 1, wherein the blade of one or more of the at least one propeller comprises a tip comprising a continuous strip of magnetic material, and the low friction coupling comprises the continuous strip of magnetic material.

15. The system of claim 1, wherein the blade of one or more of the at least one propeller comprises a tip comprising a plurality of separately formed magnets, and the low friction coupling comprises the plurality of separately formed magnets.

16. The system of claim 1, wherein at least one bearing element is arranged at an interface between tips of the blades and the at least one helical rail, and the low friction coupling comprises the at least one bearing element.

17. The system of claim 1, wherein the guideway comprises a centering rail and the vehicle comprises a vertical element engaged with the centering rail through a second low-friction coupling, wherein the centering rail and vertical element stabilize the vehicle and prevent the vehicle from rolling along its longitudinal axis.

18. The system of claim 1 wherein the blade of one or more of the at least one propeller comprises a tip comprising at least one magnet, and the guideway comprises at least one ferrous material helical rail, and the low friction coupling comprises the at least one magnet and the at least one ferrous material.

19. The system of claim 1 further comprising at least one motor configured to rotationally drive the one or more of the at least one blade of the at least one propeller, the motor is configured to rotationally drive each of the at least one blade of each of the at least one propeller.

20. The system of claim 18, wherein the blade of one or more of the at least one propeller comprises a tip comprising a reaction plate comprising at least one of copper or aluminum, configured to generate propelling force based on interaction with magnets arranged along the guideway.

21. The system of claim 1, wherein the at least one helical rail is an open-air helical rail.

22. The system of claim 1, the guideway comprising at least one non-helical rail, the at least one non-helical rail configured to provide one or more of additional suspension for the vehicle, alignment of the vehicle, and track switching.

23. The system of claim 1, wherein the vessel assembly comprises a vehicle and a shuttle, the vehicle is engaged with the shuttle, the shuttle comprises the at least one propeller and is configured to move within the internal space, and the vehicle is external to the guideway.

24. The system of claim 23 further comprising at least one motor configured to rotationally drive the blade of each of the at least one propeller.

25. The system of claim 23, wherein the at least one helical rail is an open-air helical rail.

26. The system of claim 1, wherein the low friction coupling is characterized in that it generates low or no friction, and none or low magnetic drag.

27. The system of claim 1, wherein at least one bearing element, wheel, or gear is arranged at an interface between tips of the blades and the guideway, the at least one bearing element, wheel, or gear contacts the at least one helical rail, and the low friction coupling comprises the at least one bearing element, wheel, or gear.

28. The system of claim 1, wherein the low friction coupling comprises magnetic repulsion between the blade of one or more of the at least one propeller.

29. The system of claim 1, wherein the low friction coupling comprises a groove on an end of a blade of the at least one blade of the at least one propeller, magnets on interior faces of the groove, and the groove engaging one of the at least one helical rail of the guideway, where the low friction coupling comprises a groove on the end of each blade of the at least one blade of each of the at least one propeller, magnets on the interior faces of each respective groove, and each respective groove engaging a respective one of the at least one helical rail.

30. The system of claim 1, wherein the low friction coupling comprises a groove on an end of the at least one blade of the at least one propeller, and magnets on an exterior face of one of the at least one helical rail, where the groove engages the one of the at least one helical rail, the low friction coupling comprises a groove on the end of each of the at least one blade of each of the at least one propeller, and magnets on the exterior faces of the at least one helical rail, where each groove engages a rail of the at least one helical rail.

31. The system of claim 1, wherein the low friction coupling comprises a groove on the at least one helical rail, and magnets on exterior faces a blade of the at least one blade of the at least one propeller, where the groove engages a tip of the at least one blade of the at least one propeller, the low friction coupling comprises a groove on each of the at least one helical rail, and magnets on the exterior faces of each of the at least one blade of the at least one propeller, where each groove engages the respective tip of the at least one blade of the at least one propeller.

32. The system of claim 1, wherein the low friction coupling comprises a groove on the at least one helical rail, and magnets on interior faces of the rail, and the groove engages a tip of the at least one blade of the at least one propeller, where the groove engages an end of each of the at least one blade.

33. The system of claim 1, wherein the low friction coupling comprises magnets on the at least one propeller and magnets on at least one helical rail.

34. The system of claim 1, wherein the low friction coupling comprises magnetic attraction between the at least one propeller and the at least one helical rail.

35. The system of claim 33, wherein the low friction coupling comprises no physical contact except for a magnetic mechanism retaining the magnets from contacting other magnets or magnetic metal parts.

36. The system of claim 1, wherein the low friction coupling comprises at least one C-shaped arrangement of at least one magnet on an end of the at least one blade of the at least one propeller, the arrangement engaging at least one rail of at least one helical rail, where the one rail comprises ferrous metal, where the C-shaped arrangement comprises wheels having rollers and the rollers of wheels to prevent the magnets from making physical contact with the rail.

37. The system of claim 1, wherein the low friction coupling comprises at least one rail of the at least one helical rail comprising a ferrous or magnetic metal having a "C" shape profile comprising an array of magnets and engaging an end of the at least one blade of the at least one propeller.

38. The system of claim 1, wherein the guideway is supported and stabilized by a suspension mechanism.

39. The system of claim 38, wherein the suspension mechanism comprises one or more of poles, columns, and cables, the poles and columns configured as vertical compression elements and the cables in tension, and the one or more of poles, columns, and cables, the poles and columns configured as vertical compression elements and the cables in tension are connected to the guideway.

40. The system of claim 1, further comprising at least one motor configured to rotationally drive the blades.

* * * * *